US011352169B2

(12) United States Patent
Apps

(10) Patent No.: US 11,352,169 B2
(45) Date of Patent: Jun. 7, 2022

(54) PALLET ASSEMBLY

(71) Applicant: Rehrig Pacific Company, Los Angeles, CA (US)

(72) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 75 days.

(21) Appl. No.: 16/747,276

(22) Filed: Jan. 20, 2020

(65) Prior Publication Data

US 2020/0231332 A1 Jul. 23, 2020

Related U.S. Application Data

(60) Provisional application No. 62/794,157, filed on Jan. 18, 2019.

(51) Int. Cl.
*B65D 19/00* (2006.01)

(52) U.S. Cl.
CPC ..... *B65D 19/0036* (2013.01); *B65D 2519/00034* (2013.01); *B65D 2519/00069* (2013.01); *B65D 2519/00139* (2013.01); *B65D 2519/00273* (2013.01); *B65D 2519/00288* (2013.01); *B65D 2519/00318* (2013.01); *B65D 2519/00432* (2013.01)

(58) Field of Classification Search
CPC ..... B65D 19/0036; B65D 2519/00034; B65D 2519/00069; B65D 2519/00273; B65D 2519/00288; B65D 2519/00139; B65D 2519/00432; B65D 2519/00318
USPC ..... 108/57.25
See application file for complete search history.

(56) References Cited

U.S. PATENT DOCUMENTS

| | | | |
|---|---|---|---|
| 2,602,619 | A | 7/1952 | McIntyre |
| 2,699,912 | A | 1/1955 | Cushman |
| 3,467,032 | A | 9/1969 | Rowlands et al. |
| 3,628,468 | A | 12/1971 | Angelback et al. |
| 3,664,271 | A | 5/1972 | Wolder et al. |
| 3,680,496 | A | 8/1972 | Westlake, Jr. |
| 3,710,733 | A | 1/1973 | Story |
| 3,832,955 | A | 9/1974 | Pottinger et al. |
| 3,875,280 | A | 4/1975 | Story |
| 3,938,448 | A | 2/1976 | Nishitani et al. |
| 4,016,230 | A | 4/1977 | Michel |
| 4,019,634 | A | 4/1977 | Bonnot |
| 4,159,681 | A | 7/1979 | Vandament |
| 4,183,491 | A | 1/1980 | Sanders et al. |

(Continued)

FOREIGN PATENT DOCUMENTS

| | | |
|---|---|---|
| DE | 2125549 | 12/1972 |
| DE | 3205910 | 11/1983 |

(Continued)

*Primary Examiner* — Daniel J Troy
*Assistant Examiner* — Timothy M Ayres
(74) *Attorney, Agent, or Firm* — Carlson, Gaskey & Olds, P.C.

(57) ABSTRACT

A pallet assembly includes an upper deck having a first plurality of ribs and a second plurality of ribs. The first plurality of ribs each include a first opening therethrough that opens downward. The second plurality of ribs each include a second opening therethrough that opens upward. The first openings and the second openings aligned to define a channel. A reinforcement member is disposed in the channel A plurality of columns extend from the deck.

28 Claims, 21 Drawing Sheets

(56) References Cited

U.S. PATENT DOCUMENTS

| | | | |
|---|---|---|---|
| 4,242,150 | A | 12/1980 | Maxwell |
| 4,316,419 | A | 2/1982 | Cupido |
| 4,487,136 | A | 12/1984 | Beckway |
| 4,597,338 | A | 7/1986 | Kreeger |
| 4,604,014 | A | 8/1986 | Frano |
| 4,606,278 | A | 8/1986 | Shuert |
| 4,735,154 | A | 4/1988 | Hemery |
| 4,843,976 | A | 7/1989 | Pigott et al. |
| 4,850,284 | A | 7/1989 | DeGroot et al. |
| 4,879,956 | A | 11/1989 | Shuert |
| 5,042,396 | A | 8/1991 | Shuert |
| 5,094,175 | A | 3/1992 | Christie |
| 5,117,762 | A | 6/1992 | Shuert |
| 5,160,029 | A | 11/1992 | Pigott et al. |
| 5,197,395 | A | 3/1993 | Pigott et al. |
| 5,197,396 | A | 3/1993 | Breezer et al. |
| 5,289,781 | A | 3/1994 | Beckway |
| 5,343,814 | A | 9/1994 | Pigott et al. |
| 5,351,629 | A | 10/1994 | Breezer et al. |
| 5,367,961 | A | 11/1994 | Arai et al. |
| 5,390,467 | A | 2/1995 | Shuert |
| 5,401,347 | A | 3/1995 | Shuert |
| 5,404,829 | A | 4/1995 | Shuert |
| 5,408,937 | A | 4/1995 | Knight, IV et al. |
| 5,413,052 | A | 5/1995 | Breezer et al. |
| 5,483,899 | A | 1/1996 | Christie |
| 5,520,120 | A | 5/1996 | Badger |
| 5,579,686 | A | 12/1996 | Pigott et al. |
| 5,687,532 | A | 11/1997 | Torrey |
| 5,736,221 | A | 4/1998 | Hardigg et al. |
| 5,758,855 | A | 6/1998 | Jordan et al. |
| 5,791,262 | A | 8/1998 | Knight et al. |
| 5,806,436 | A | 9/1998 | Weichenrieder, Sr. et al. |
| 5,813,355 | A | 9/1998 | Brown et al. |
| 5,868,080 | A | 2/1999 | Wyler et al. |
| 5,887,529 | A | 3/1999 | John et al. |
| 5,890,437 | A | 4/1999 | Hill |
| 5,894,803 | A | 4/1999 | Kuga |
| 5,937,767 | A | 8/1999 | Togawa et al. |
| 5,950,545 | A | 9/1999 | Shuert |
| 5,950,546 | A | 9/1999 | Brown et al. |
| 5,996,508 | A | 12/1999 | Constantino et al. |
| 6,006,677 | A | 12/1999 | Apps et al. |
| 6,021,721 | A | 2/2000 | Rushton |
| 6,029,583 | A | 2/2000 | LeTrudet |
| 6,053,466 | A | 4/2000 | Jordan et al. |
| 6,095,061 | A | 8/2000 | Perazzo |
| 6,109,190 | A | 8/2000 | Hale et al. |
| 6,118,164 | A | 9/2000 | Seefeldt |
| 6,123,032 | A | 9/2000 | Ohanesian |
| 6,125,770 | A | 10/2000 | Brandenburg |
| 6,138,582 | A | 10/2000 | Fujii et al. |
| 6,173,657 | B1 | 1/2001 | Espejo |
| 6,173,659 | B1 | 1/2001 | Danks et al. |
| 6,199,487 | B1 | 3/2001 | Coddington |
| 6,199,488 | B1 | 3/2001 | Favaron et al. |
| 6,237,509 | B1 | 5/2001 | Ishido et al. |
| 6,250,234 | B1 | 6/2001 | Apps |
| 6,263,807 | B1 | 7/2001 | Fox et al. |
| 6,283,044 | B1 | 9/2001 | Apps |
| 6,289,823 | B1 | 9/2001 | Koefelda et al. |
| 6,305,301 | B1 | 10/2001 | Piper, Jr. et al. |
| 6,357,366 | B1 | 3/2002 | Frankenberg |
| 6,389,990 | B1 | 5/2002 | Apps |
| 6,446,563 | B1 | 9/2002 | Ohanesian |
| 6,564,725 | B2 | 5/2003 | Hale |
| 6,574,934 | B1 | 6/2003 | Queirel |
| 6,584,914 | B1 | 7/2003 | Koefelda |
| 6,622,642 | B2 | 9/2003 | Ohanesian |
| 6,705,237 | B2 | 3/2004 | Moore, Jr. et al. |
| 6,718,888 | B2 | 4/2004 | Muirhead |
| 6,742,460 | B2 | 6/2004 | Meyer et al. |
| 6,745,703 | B2 | 6/2004 | Torrey et al. |
| 6,748,876 | B2 | 6/2004 | Preisler et al. |
| 6,784,234 | B2 | 8/2004 | Adedeji et al. |
| 6,807,910 | B2 | 10/2004 | Apps |
| 6,886,475 | B2 | 5/2005 | Apps et al. |
| 6,976,437 | B2 | 12/2005 | Fisch et al. |
| 7,086,339 | B2 | 8/2006 | Apps et al. |
| 7,146,773 | B2 | 12/2006 | Wilson |
| 7,165,499 | B2 | 1/2007 | Apps et al. |
| 7,293,509 | B2 | 11/2007 | Hassell |
| 7,343,865 | B2 | 3/2008 | Shuert |
| 7,549,259 | B2 | 6/2009 | Calle |
| 7,779,763 | B2 | 8/2010 | Valentinsson |
| 7,779,765 | B2 | 8/2010 | Donnell, Jr. et al. |
| 7,798,465 | B1 | 9/2010 | Meverden |
| 7,845,113 | B2 | 12/2010 | Casimaty et al. |
| 7,908,979 | B2 | 3/2011 | Koshida et al. |
| 7,918,166 | B2 | 4/2011 | Apps et al. |
| 8,291,838 | B2 | 10/2012 | Apps |
| 8,770,115 | B2 | 7/2014 | Apps et al. |
| 8,776,697 | B1 | 7/2014 | O'Connell |
| 8,943,981 | B2 | 2/2015 | Kelly et al. |
| 9,027,487 | B1 | 5/2015 | O'Connell |
| 9,221,580 | B2 | 12/2015 | Zelek et al. |
| D751,789 | S | 3/2016 | Cote et al. |
| 9,272,810 | B2 | 3/2016 | Ogburn |
| 9,452,864 | B2 | 9/2016 | Apps |
| 9,511,897 | B2 | 12/2016 | Liao et al. |
| 9,511,898 | B2 | 12/2016 | Liao et al. |
| 9,669,962 | B2 | 6/2017 | Liao et al. |
| D796,774 | S | 9/2017 | Simmons et al. |
| 9,802,732 | B2 | 10/2017 | Clark et al. |
| D816,939 | S | 5/2018 | Blosser et al. |
| 10,053,261 | B2 | 8/2018 | Storteboom et al. |
| 10,081,454 | B2 | 9/2018 | Storteboom et al. |
| 10,118,731 | B2 | 11/2018 | Apps et al. |
| 10,532,852 | B2 | 1/2020 | Apps et al. |
| 2001/0029874 | A1 | 10/2001 | Muirhead |
| 2001/0031807 | A1 | 10/2001 | Adedeji et al. |
| 2002/0104465 | A1 | 8/2002 | Ohanesian |
| 2002/0134284 | A1 | 9/2002 | Apps |
| 2003/0075082 | A1 | 4/2003 | Apps |
| 2003/0079658 | A1 | 5/2003 | Torrey et al. |
| 2003/0079660 | A1 | 5/2003 | Torrey et al. |
| 2005/0103237 | A1 | 5/2005 | Moore, Jr. et al. |
| 2005/0145145 | A1 | 7/2005 | Ogburn et al. |
| 2006/0201400 | A1 | 9/2006 | Moore, Jr. et al. |
| 2006/0201402 | A1 | 9/2006 | Moore, Jr. et al. |
| 2006/0236904 | A1 | 10/2006 | Apps et al. |
| 2007/0062420 | A1 | 3/2007 | Apps et al. |
| 2007/0163473 | A1 | 6/2007 | Shuert |
| 2008/0143514 | A1 | 6/2008 | Valentinsson |
| 2008/0210140 | A1 | 9/2008 | Valentinsson |
| 2008/0236454 | A1 | 10/2008 | Naidu et al. |
| 2009/0050029 | A1 | 2/2009 | Ogburn |
| 2010/0083881 | A1 | 4/2010 | Apps et al. |
| 2010/0154685 | A1 | 6/2010 | Arinstein |
| 2011/0120353 | A1 | 5/2011 | Jensen et al. |
| 2011/0259249 | A1 | 10/2011 | Ogburn et al. |
| 2012/0160734 | A1 | 6/2012 | Linares |
| 2012/0325125 | A1 | 12/2012 | Apps et al. |
| 2013/0220184 | A1 | 8/2013 | Apps et al. |
| 2014/0158025 | A1 | 6/2014 | Apps |
| 2014/0261103 | A1 | 9/2014 | Kelly et al. |
| 2016/0068302 | A1 | 3/2016 | Clark et al. |
| 2016/0137342 | A1 | 5/2016 | Liao et al. |
| 2016/0221714 | A1 | 8/2016 | Liao et al. |
| 2016/0236815 | A1 | 8/2016 | Liao et al. |
| 2016/0288951 | A1 | 10/2016 | Rader et al. |
| 2017/0021963 | A1* | 1/2017 | Apps ..... B65D 19/0069 |
| 2018/0322453 | A1 | 11/2018 | Lantz et al. |
| 2020/0039686 | A1* | 2/2020 | Edwards ..... B65D 19/0032 |
| 2020/0180812 | A1* | 6/2020 | D'Emidio ..... B65D 19/0016 |

FOREIGN PATENT DOCUMENTS

| | | | | |
|---|---|---|---|---|
| DE | 102016200040 | A1 * | 7/2017 | ..... B28B 7/0055 |
| EP | 68586 | | 1/1983 | |
| EP | 997383 | | 5/2000 | |
| EP | 1973788 | | 10/2008 | |
| EP | 2733084 | A1 * | 5/2014 | ..... B65D 19/001 |
| EP | 3050816 | A1 * | 8/2016 | ..... B65D 19/0026 |

(56) References Cited

FOREIGN PATENT DOCUMENTS

| | | | | | |
|---|---|---|---|---|---|
| GB | 1479181 | | | 7/1977 | |
| GB | 2272203 | | | 5/1994 | |
| GB | 2272203 | A | * | 5/1994 | ..... B65D 19/0016 |
| JP | 2008114913 | | | 5/2008 | |
| WO | 9001448 | | | 2/1990 | |
| WO | 9935041 | | | 7/1999 | |
| WO | 00001588 | A1 | | 1/2000 | |
| WO | 00020495 | | | 4/2000 | |
| WO | 0164526 | | | 7/2001 | |
| WO | 0216214 | | | 2/2002 | |
| WO | 03035495 | | | 1/2003 | |
| WO | 03035496 | | | 1/2003 | |
| WO | 2004096652 | | | 11/2004 | |
| WO | 2005118412 | | | 12/2005 | |
| WO | 2007087065 | A2 | | 8/2007 | |
| WO | 2009099314 | | | 8/2009 | |
| WO | 2010008264 | | | 1/2010 | |
| WO | 2018093481 | | | 5/2018 | |

* cited by examiner

PALLET ASSEMBLY

BACKGROUND

A pallet for use with the harvesting, processing and/or transportation of food products should be easy to clean and inspect for contamination as it moves through the supply chain. Plastic pallets in general are a better choice than traditional wood pallets in a food application because they do not absorb moisture and can be easily cleaned and sanitized. Automated cleaning lines are now common which can clean pallets efficiently with a combination of hot water, mild detergents and sanitizers. However, the high pressure wash solution must be able to get to and drain away from all surfaces sufficiently. The challenge is to make such a pallet easily cleanable but still maintain all the handling, durability and weight benefits of traditional plastic pallets.

Welding decks and/or adding reinforcement are the most common ways to get a polyolefin pallet to perform similar to wood. However, welding decks can create pockets and ledges that make efficient cleaning difficult. Reinforcement rods can also create traps for dirt and moisture to accumulate.

SUMMARY

The pallet assembly disclosed herein combines a low cost and durable polyethylene with reinforcements in a way that is easily cleanable and still performs similar to wood in stiffness. All surfaces are easily accessed so that one can see if the pallet is clean or contaminated.

Instead of trapping the reinforcement members between the top deck and the columns (or between the top deck and bottom deck/runners) like is commonly done in other pallets, the reinforcement members are trapped entirely in one of the decks. This protects the reinforcement members from damage due to contact with steel fork trucks and pallet jacks during normal use. The reinforcement members are inserted through the sides of the deck in a sequence that traps the internal reinforcement members first, then the perimeter reinforcement members are inserted to complete the assembly. A series of over/under ribs creates the internal structure to allow the insertion of the reinforcement members and to support them in use as well as result in a simple and easy to clean structure.

Traditional reinforcement shapes would ideally be I-beams or rectangular tubes to optimize the strength to weight ratio of the reinforcement member. However, in the example pallet assembly disclosed herein ledges or large flat surfaces running horizontally are minimized by choosing the cross-section to be a round tube. Since these tubes are hollow they will be capped on each end to prevent contamination getting inside. A round tube, while not structurally ideal for load bearing in a pallet (an I-beam is structurally an ideal shape for vertical load bearing in a pallet), is ideal for allowing contaminants to flow off and around as well as cleaning solutions. Of course, ellipses or other irregular cross-sections without horizontal ledges or horizontal flat surfaces could also be used. "Round" is used in this very general sense, including but not limited to annular (cylindrical) or elliptical.

The most preferred material for the reinforcement members in a high end food application is stainless steel due to the material's combination of corrosion resistance, strength and ability to sanitize. However, other materials such as coated steel, aluminum, plastic and various composites may be appropriate in less demanding applications.

The structure of both decks is very open top to bottom with only mild (narrow) T-ribs on the top deck to provide extra surface area to support the loads. Even the bases of the T-ribs are sloped and radiused to promote water drainage. The bottom deck (runners) has a little more surface area on top for strength/durability and to resist damage from forks and pallet jack wheels. All pockets created by the ribs and walls will drain when upright and upside down to promote good cleaning. In assembly all sides of the reinforcement members are visible and accessible through the decks for cleaning. Only where the ribs hold the reinforcement tightly is there contact. Because the reinforcement channels create large openings in both directions it is envisioned that these openings will be closed off for a light duty non-reinforced version or a plastic tube can be used to fill the gap.

The top and bottom deck are joined together at the columns by a weld joint on a single plane. This joint is accessible from the top or bottom so that it can be cleaned. Typically a hotplate weld joint will create a small ledge on each side in a sort of mushroom shape as the weld material is pushed away from the joint due to heat and pressure. This is the weld bead. The exterior bead can be removed mechanically after welding for a more sanitary and finished look. The inside bead is accessible for cleaning. A snap fit joint could also be used for this assembly but the overlapping features needed to make this joint strong would introduce areas that are not easy to clean so a weld is preferred (although not exclusively).

DETAILED DESCRIPTION

Figure 1:
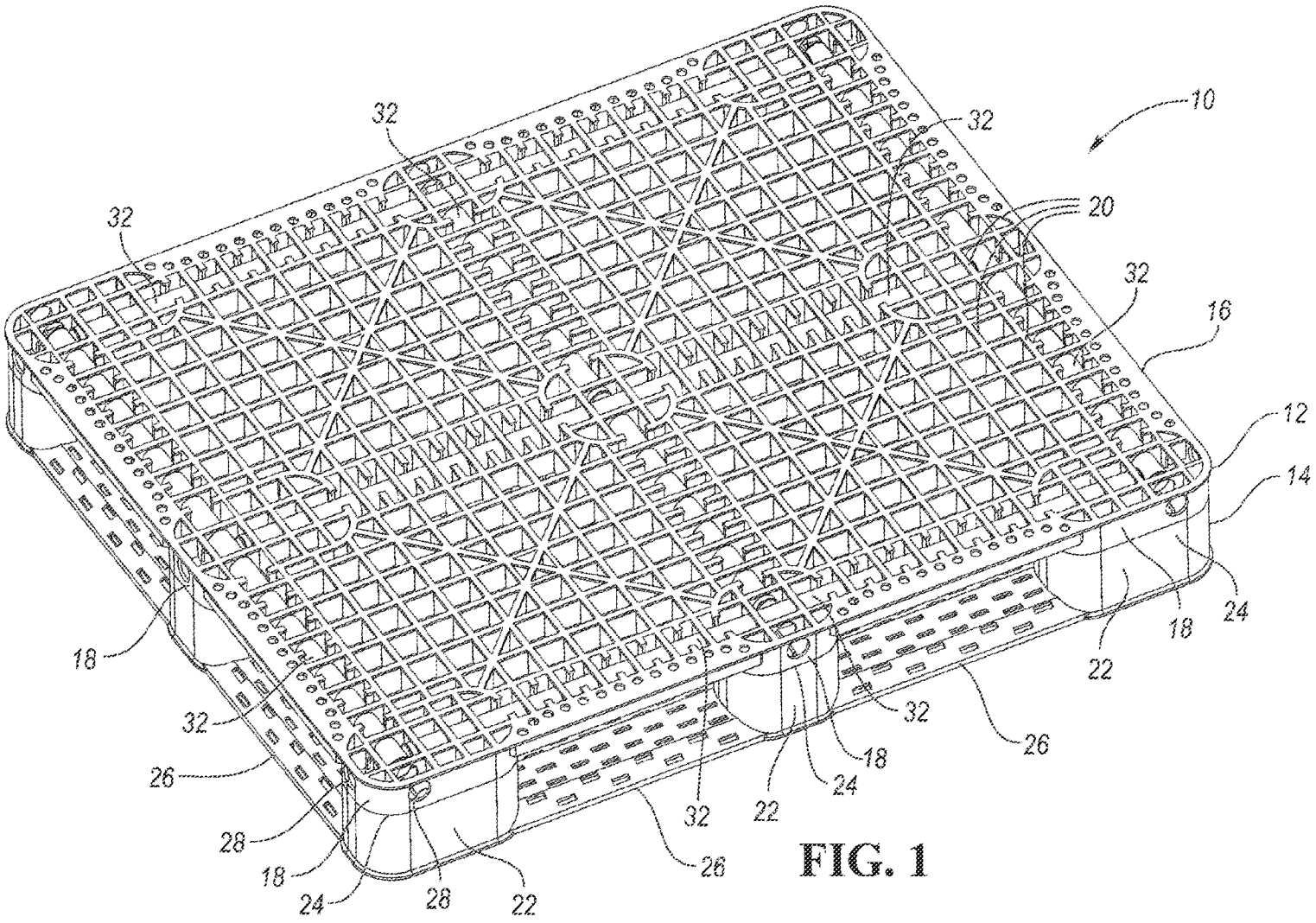
FIG. 1 is a perspective view of a pallet assembly according to one example embodiment.

A pallet assembly 10 according to one embodiment is shown in FIG. 1. The pallet assembly 10 includes an upper portion 12 and a lower portion 14 joined together. The upper portion 12 includes an upper deck 16 integrally molded with a plurality of upper column portions 18 extending downward from the upper deck 16. The upper deck 16 is formed primarily of a plurality of intersecting vertically-oriented ribs 20.

The lower portion 14 includes a plurality of lower column portions 22 extending upward from a plurality of runners 26 connecting lower ends of the lower column portions 22 and integrally molded therewith. When assembled as shown in FIG. 1, the lower portion 14 is joined to the upper portion 12 by joining the lower column portions 22 to the upper column portions 18, such as by hot plate welding (alternatively by snap-fit connections or adhesive, but preferably by hot plate welding). The joined upper column portions 18 and lower column portions 22 form columns 24. The runners 26 together could be considered a "lower deck."

The upper portion 12 further includes a plurality of channels 28 formed therethrough, generally parallel to the upper support surface of the deck 16, one along each peripheral edge and two intersecting perpendicularly through the center of the deck 16. The channels 28 lead into the deck 16 through openings in the upper column portions 18, two in each of the corner upper column portions 18 and one through each of the non-corner peripheral upper column portions 18. In FIG. 1, reinforcement members 32 are disposed in the channels 28 and will be explained in more detail later below.

Figure 2:
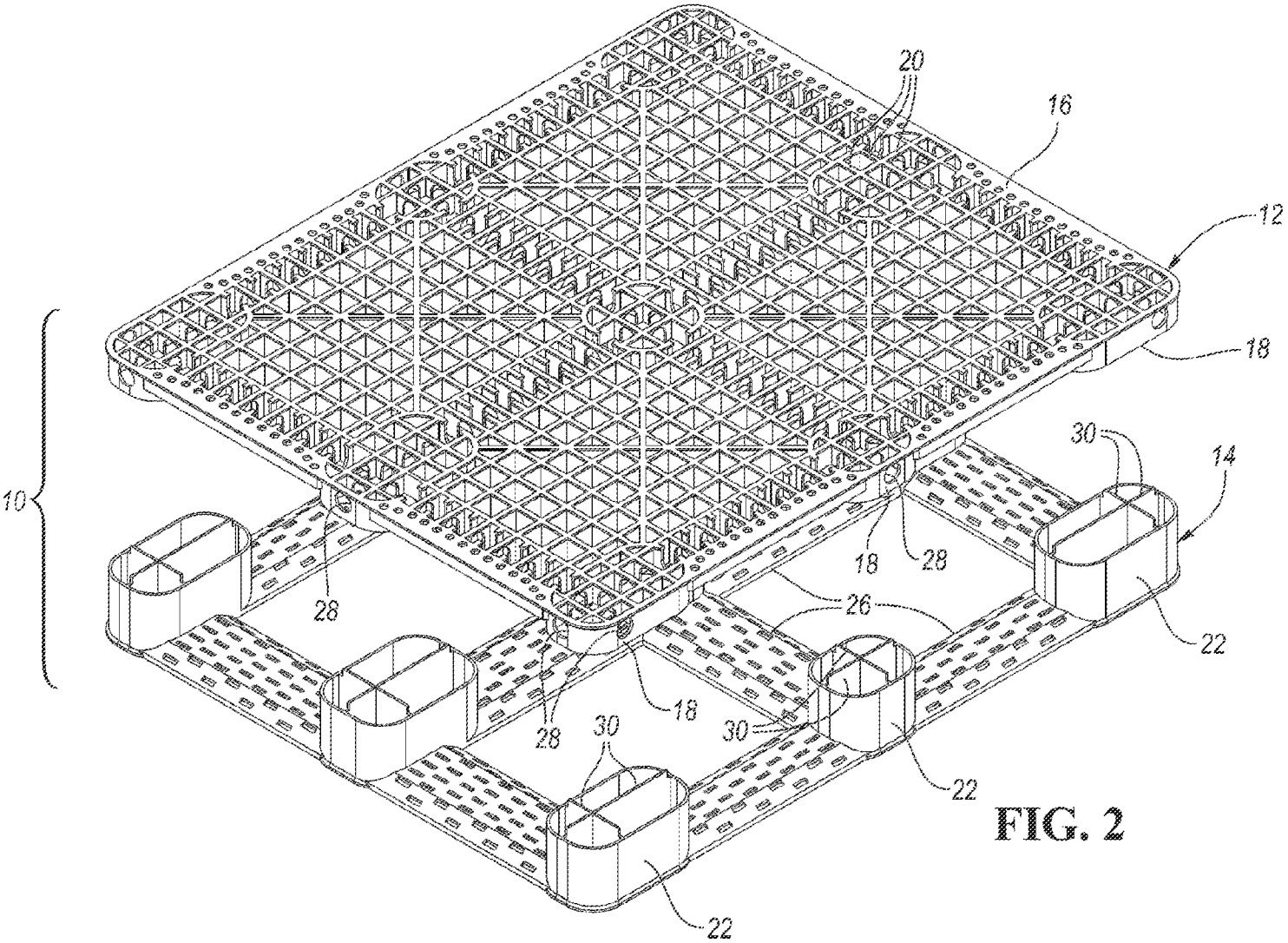
FIG. 2 is an exploded view of the pallet assembly of FIG. 1 without the reinforcement members.
Figure 3:
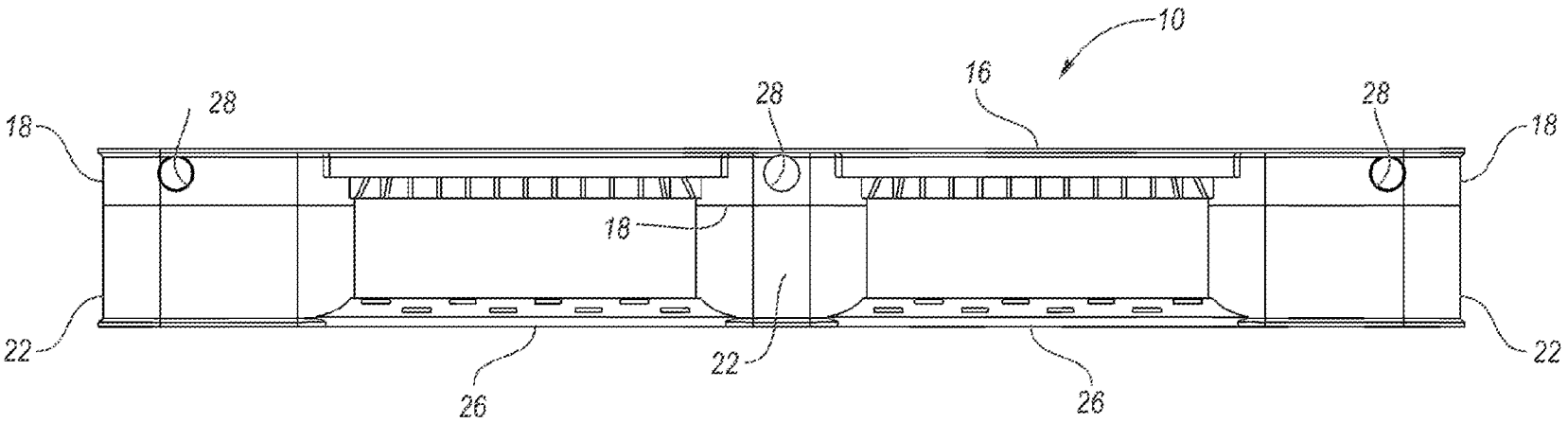
FIG. 3 is a side view of the pallet assembly of FIG. 1.

FIG. 2 is an exploded view of the pallet assembly 10 of FIG. 1 (without the reinforcement members 32). The pallet assembly 10 includes the upper portion 12 and the lower portion 14. The lower column portions 22 each include a pair of perpendicular vertical column ribs 30, each of which is generally parallel to one of the runners 26. The column ribs 30 have upper edges that are higher than the peripheral walls of the lower column portions 22. FIG. 3 is a side view of the pallet assembly 10 of FIG. 1.

Figure 4:
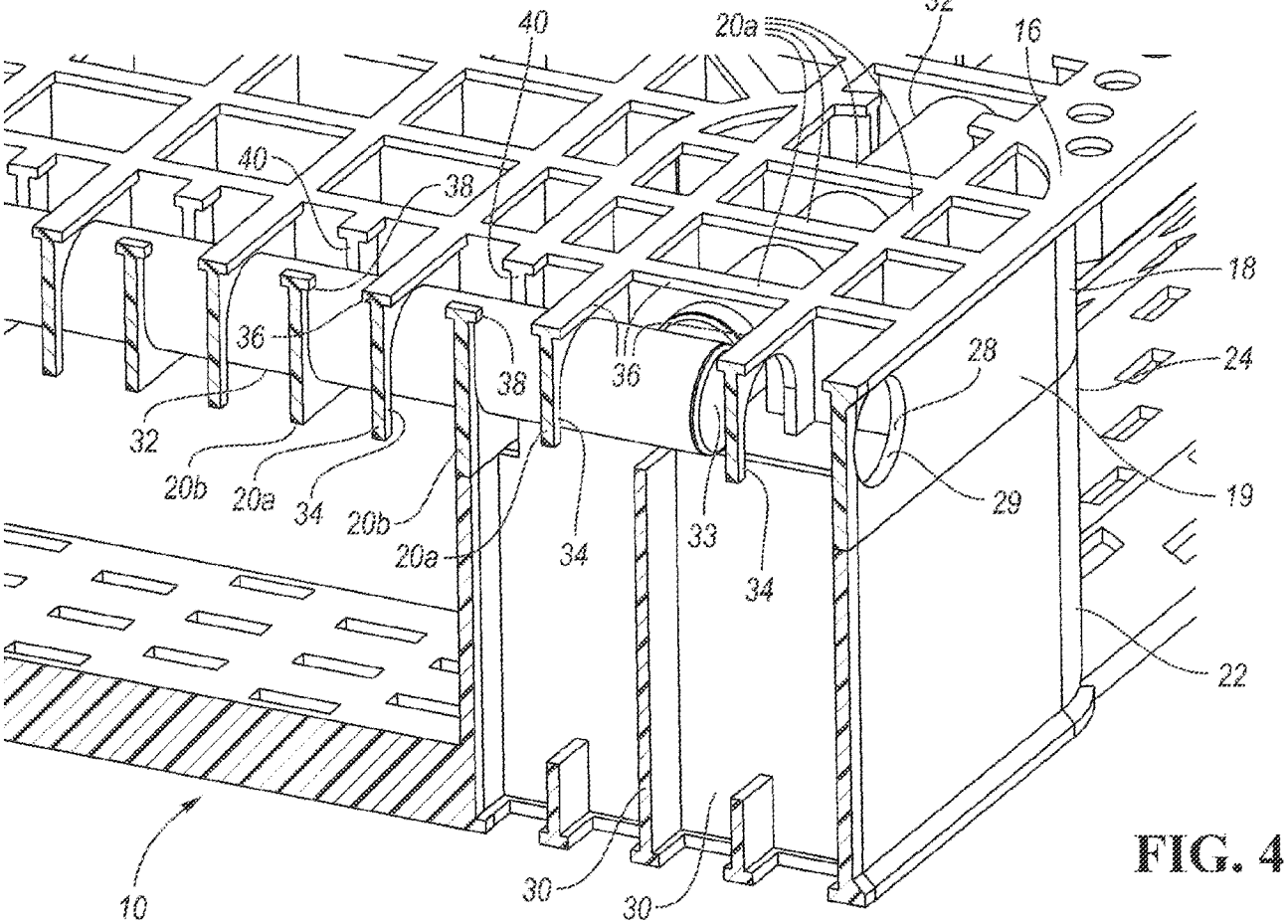
FIG. 4 is a perspective view of the pallet assembly of FIG. 1, partially broken away, with reinforcement members within the channels.

FIG. 4 is a perspective view of the pallet assembly 10, partially broken away, with reinforcement members 32 within the channels 28. As shown, the ribs 20 forming the upper deck 16 include first ribs 20*a* and second ribs 20*b*. The first ribs 20*a* extend above and on either side of the reinforcement members 32, but are open below the reinforcement members 32. The first ribs 20*a* include upper horizontal flanges 36 at upper edges thereof. Where the first ribs 20*a* intersect one of the channels 28, the first ribs 20*a* define openings 34 that open downwardly. The first ribs 20*a* abut the upper half of the circumference of the reinforcement member 32 and then extend straight down to open downwardly.

The second ribs 20*b* include upper horizontal flanges 38 at upper edges thereof. The second ribs 20*b* extend below and on either side of the reinforcement members 32, but are open above the reinforcement members 32. Where the second ribs 20*b* intersect one of the channels 28, the second ribs 20*b* define openings 40 that opening upwardly. The second ribs 20*b* abut the lower half of the circumference of the reinforcement member 32 and then extend straight upward to open upwardly.

The channel 28 also extends through an opening 29 through an outer wall 19 of the upper column portion 18. The outer wall 19 of the upper column portion 18 completely circumscribes the opening 29, although this is not essential. The outer wall 19 of the upper column portion 18 extends downward below the uppermost edges of the column ribs 30.

Away from the columns 24, the first ribs 20*a* alternate with the second ribs 20*b*. Within the columns 24, there are only first ribs 20*a*. Within the columns 24, the first ribs 20*a* are offset from the column ribs 30 that are parallel to the first ribs 20*a*. Within the columns 24, the openings 34 of the first ribs 20*a* align with the column ribs 30 that are perpendicular to the first ribs 20*a*. As shown, the column ribs 30 are aligned with the reinforcement members 32 and abut the reinforcement members 32.

The reinforcement members 32 are preferably a hollow cylinder with end caps 33 secured to ends of the reinforcement members 32 to seal the interiors thereof. The end caps 33 may be secured by adhesive, threads, snap-fit, interference fit, or similar methods. Again, traditional reinforcement member cross-sections would ideally be I-beams or rectangular tubes to optimize the strength to weight ratio. However, in this design, in order to minimize ledges or large flat surfaces running horizontally, a hollow cylinder (or a round tube) is provided. A hollow cylinder, while not structurally ideal for load bearing in a pallet, is ideal for allowing contaminants and cleaning solutions to flow off and around. The first ribs 20*a* and second ribs 20*b*, being open downwardly and upwardly, provide access to the reinforcement members 32 and provide good drainage around the reinforcement members 32.

Figure 6:
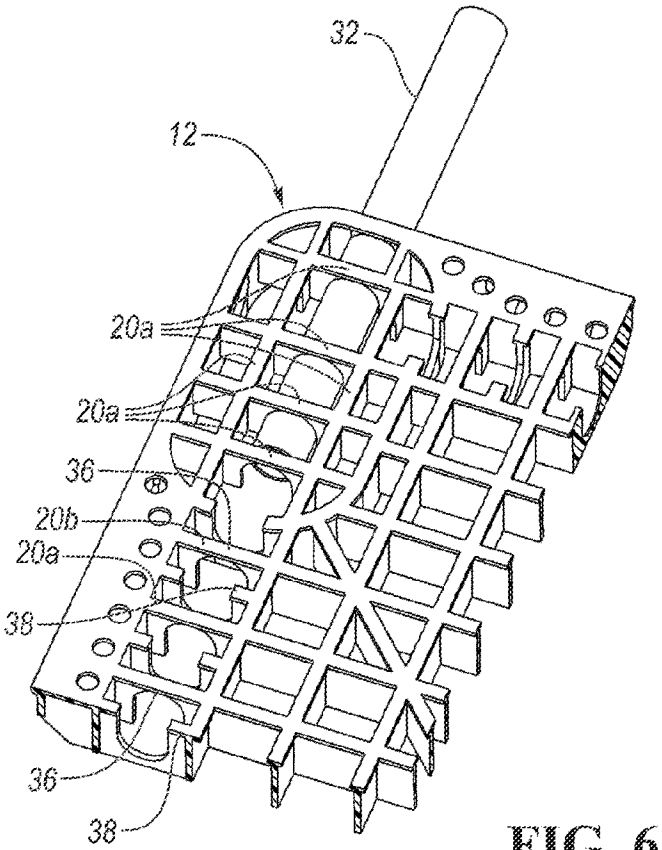
FIGS. 5-10 show a sequence for inserting the reinforcement members into the upper deck of the pallet assembly of FIG. 1.
Figure 5:
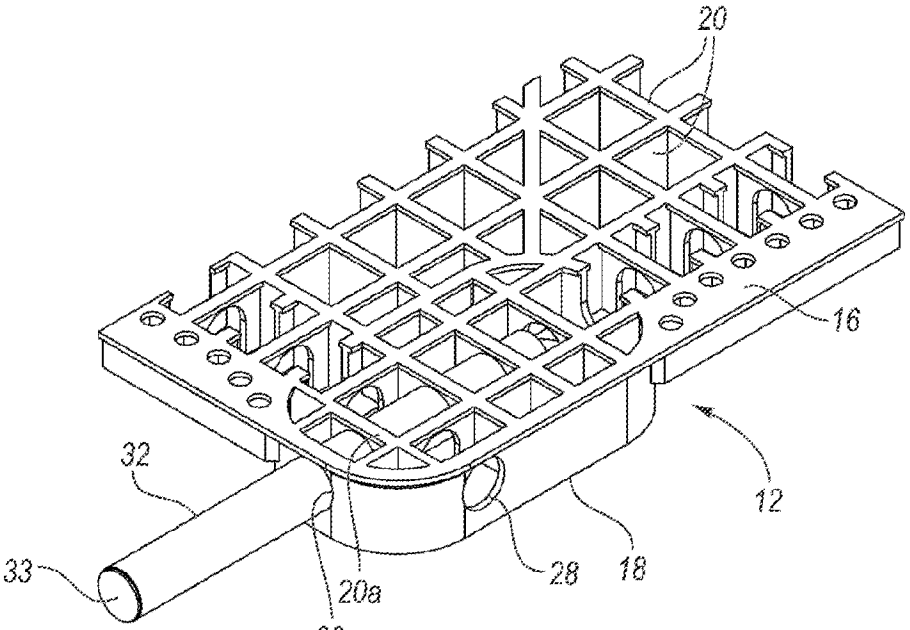
Figure 8:
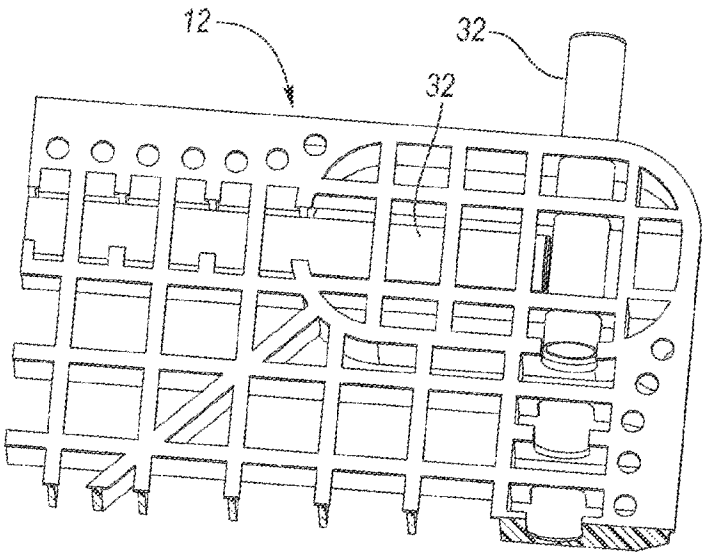
Figure 7:
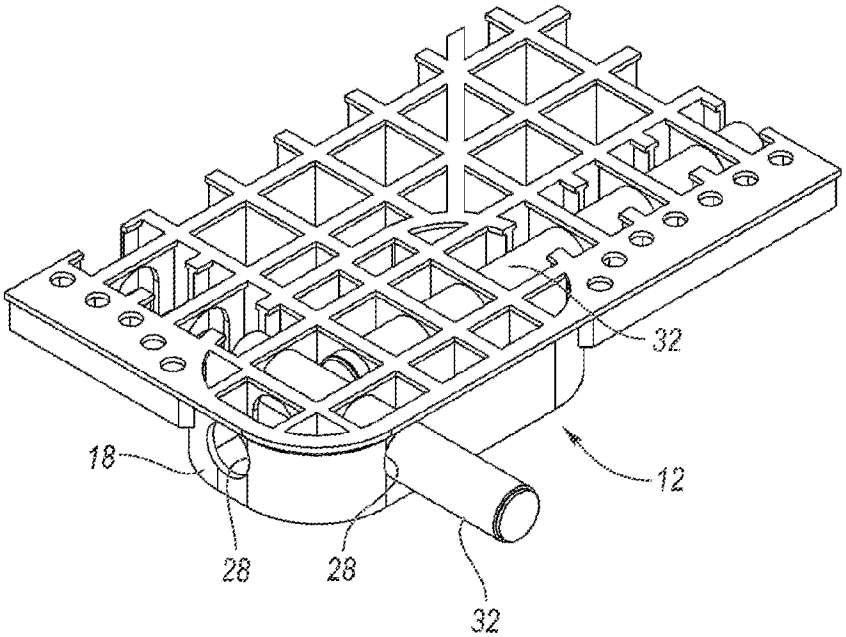
Figure 10:
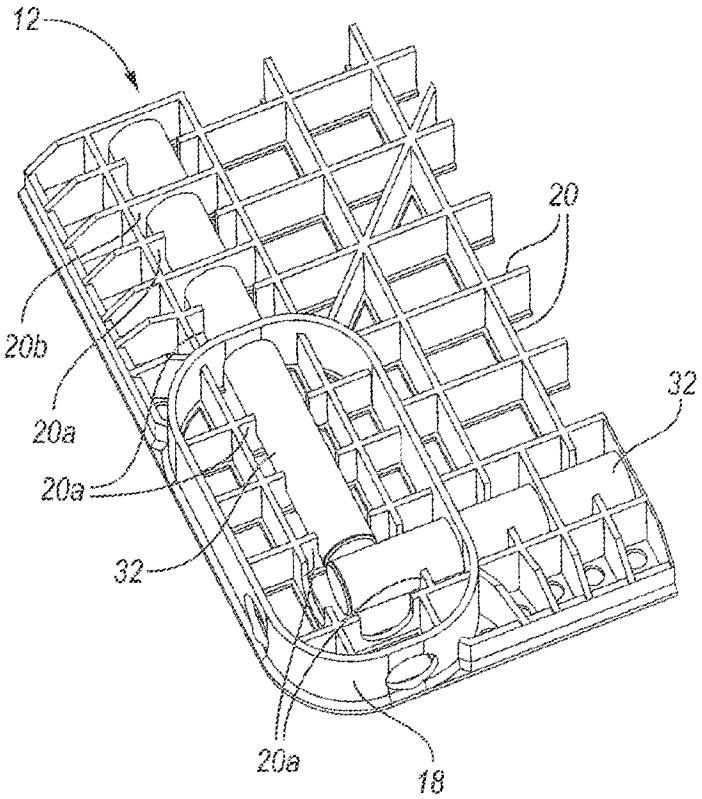
Figure 9:
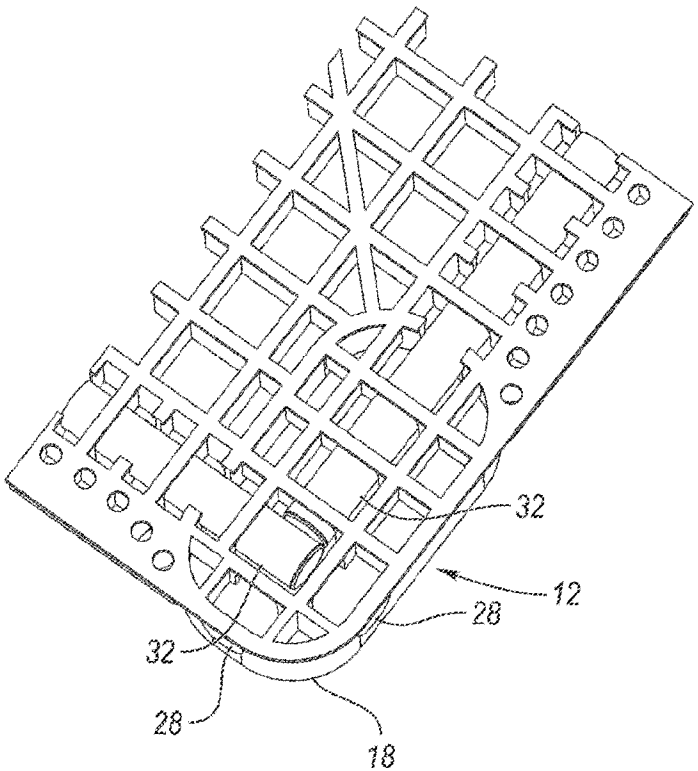

FIGS. 5 and 6 show a reinforcement member 32 being inserted through one channel 28 in a corner column upper portion 18. Referring to FIGS. 7 and 8, another reinforcement member 32 is then inserted past the first reinforcement member 32 through the other, perpendicular channel 28 in the corner column upper portion 18. As shown in FIGS. 9-10, the second-inserted reinforcement member 32 preferably blocks the axial end of the first-inserted reinforcement member 32 within the upper column portion 18.

Figure 12:
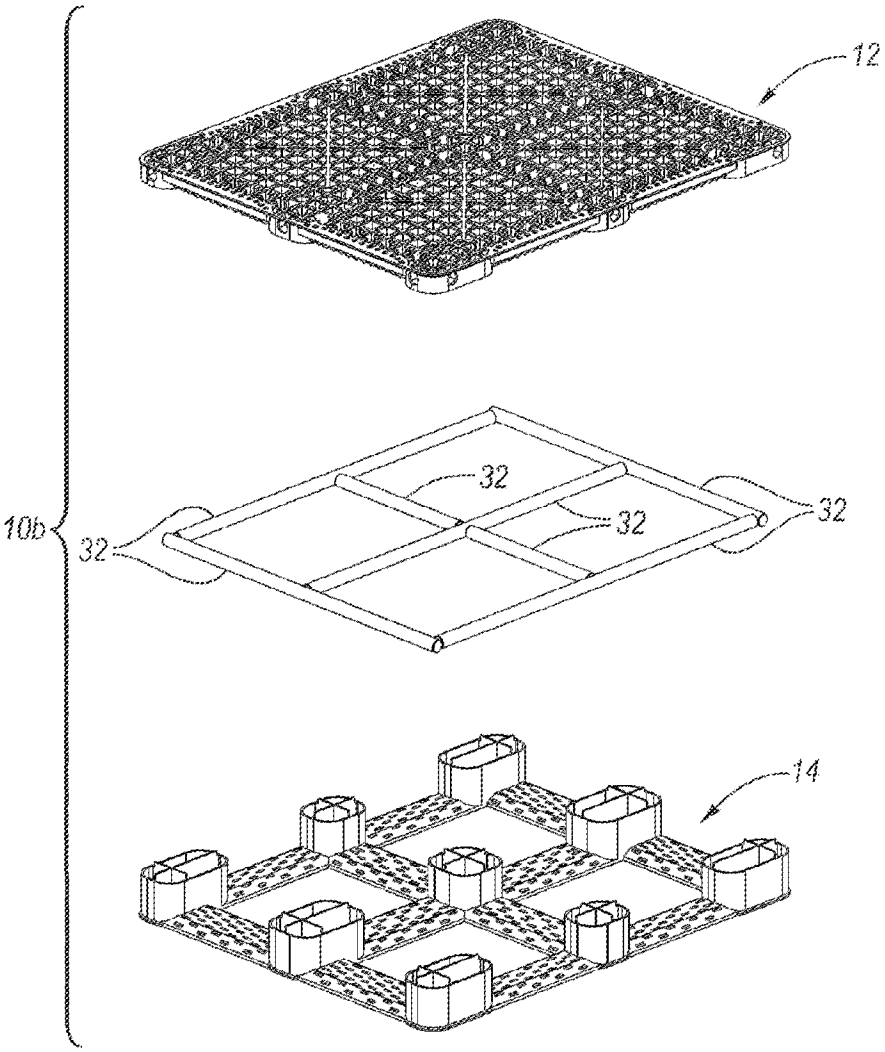
FIG. 12 is an exploded view of the pallet assembly of FIG. 1 with the reinforcement members in a "length-racking" configuration.
Figure 11:
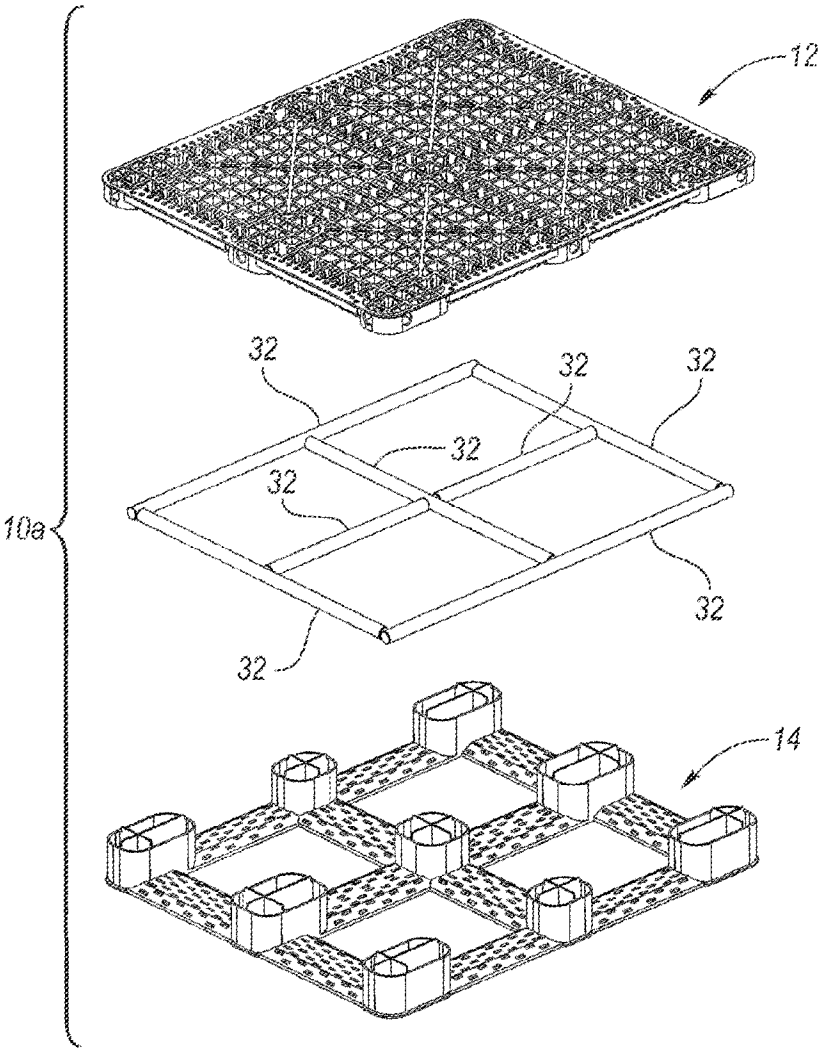
FIG. 11 is an exploded view of the pallet assembly of FIG. 1 with the reinforcement members in a "width-racking" configuration.

As shown in FIGS. 11 and 12, using the method described above with respect to FIGS. 5-10, the pallet assembly 10 can be configured with reinforcement members 32 in two ways. Note that with respect to the interior (non-periphery) reinforcement members 32, in one dimension, there will be a single continuous reinforcement member 32 and in the other dimension there will be two shorter discontinuous reinforcement members 32 interrupted by the continuous reinforcement member 32. Since the single, continuous reinforcement member 32 provides more reinforcement, that reinforcement member 32 should be arranged according to the intended racking orientation for the pallet assembly 10.

First, in FIG. 11, a "width-racking" configuration of the pallet assembly 10*a* is shown. In this configuration, the interior width-extending reinforcement member 32 is a single continuous reinforcement member 32.

In FIG. 12, a "length-racking" configuration of the pallet assembly 10*b* is shown. In this configuration, the interior length-extending reinforcement member 32 is a single continuous reinforcement member 32.

Figure 13:
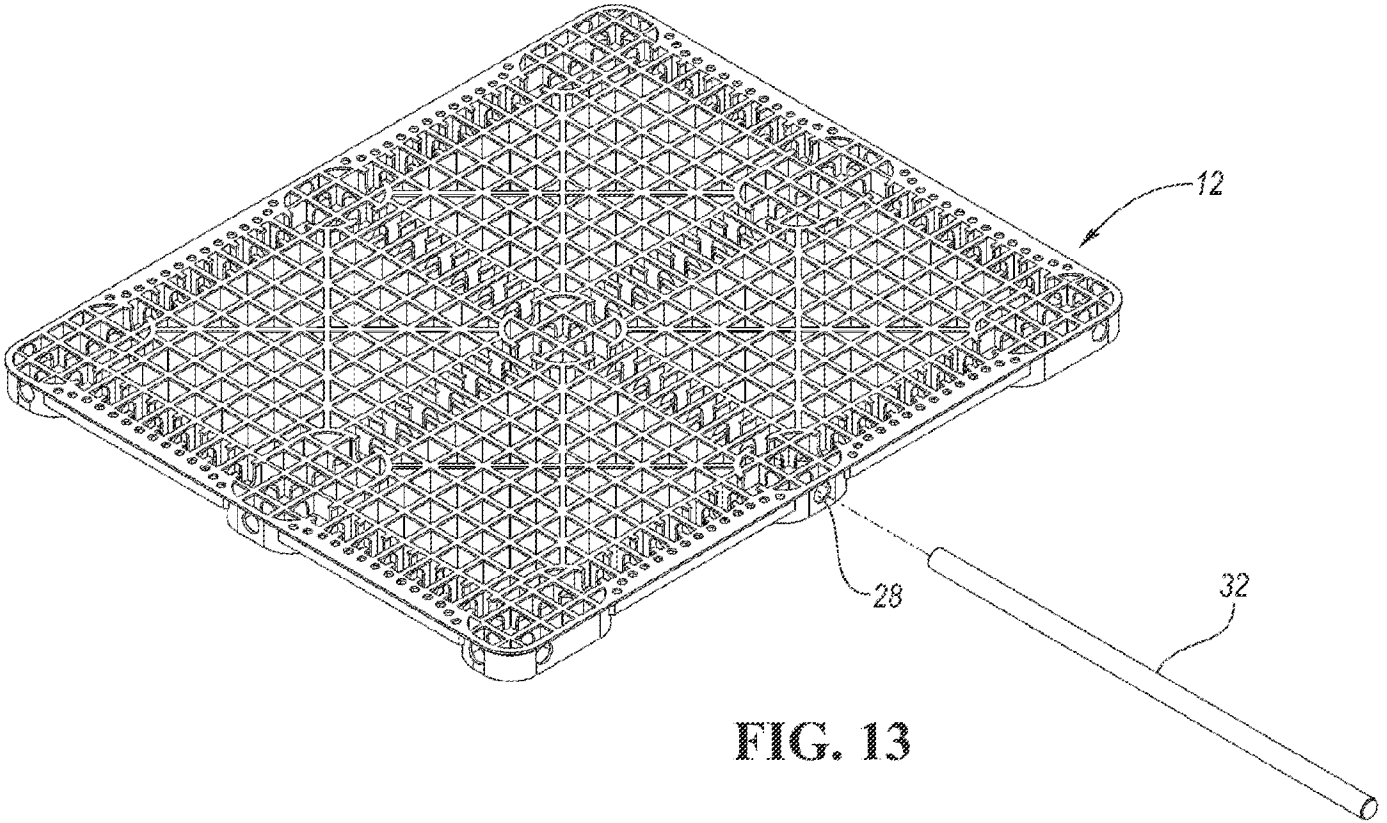
FIG. 13 is an exploded view of the upper deck of the pallet assembly of FIG. 1 and a reinforcement member in a first step of being inserted in a width-racking configuration.
Figure 14:
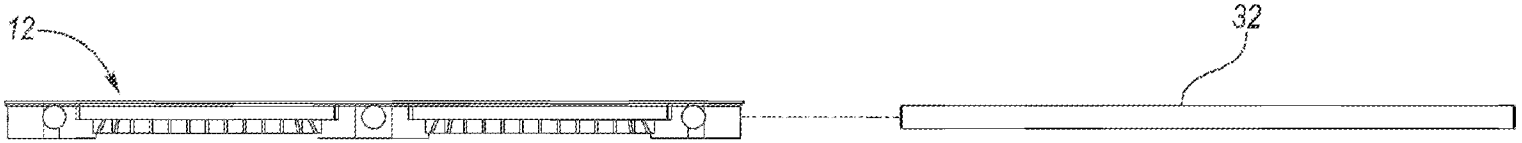
FIG. 14 is an end view of the upper deck and reinforcement member of FIG. 13.

FIGS. 13 and 14 show a first step in assembling pallet assembly 10*a* in the width-racking configuration. In the first step, the single continuous interior reinforcement member 32 is inserted into the channel 28 in the middle (non-corner) upper column portion 18 of the side edge of the upper portion 12.

Figure 15:
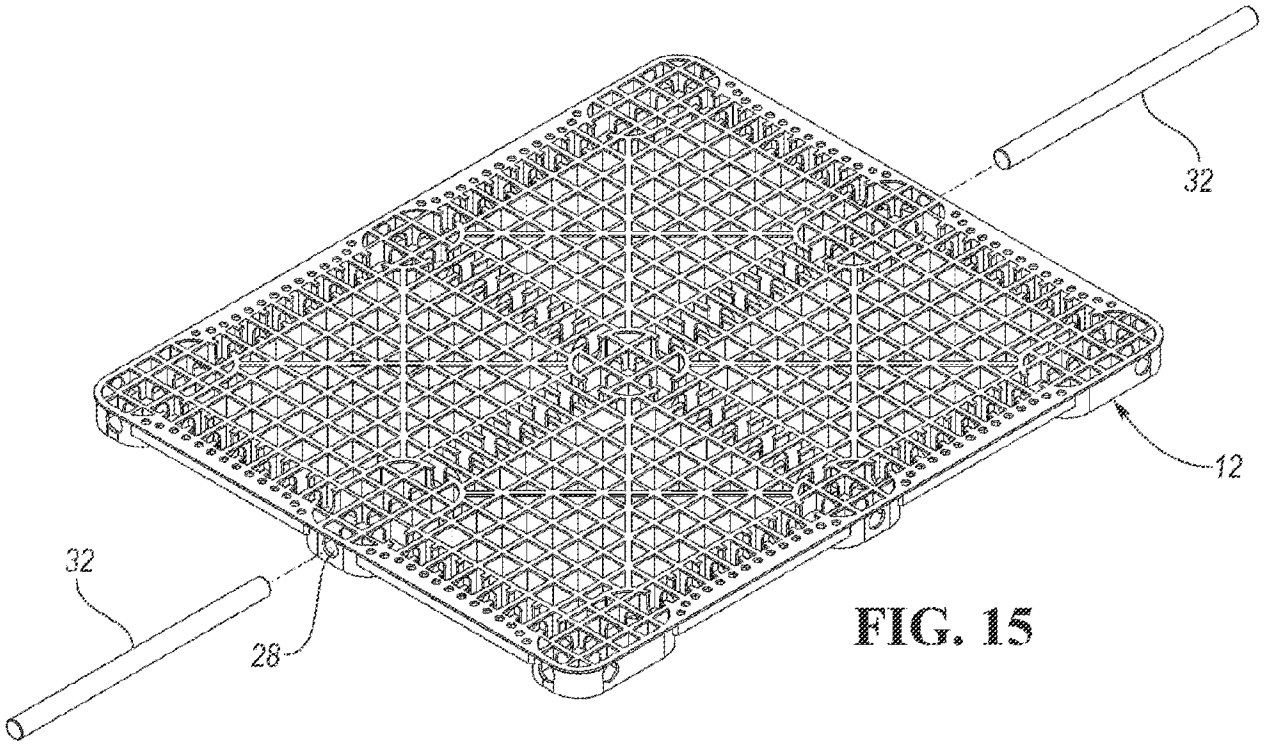
FIGS. 15 and 16 show a second step in assembling pallet assembly in the width-racking configuration.
Figure 16:
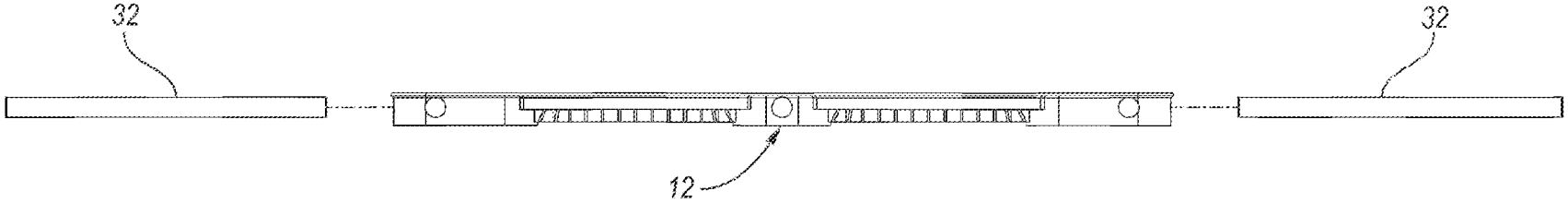

FIGS. 15 and 16 show a second step in assembling pallet assembly 10*a* in the width-racking configuration. In the second step, the two shorter, non-continuous interior reinforcement members 32 are inserted into the channels 28 in the middle upper column portion 18 of the end edges of the upper portion 12 toward the first reinforcement member 32.

Figure 17:
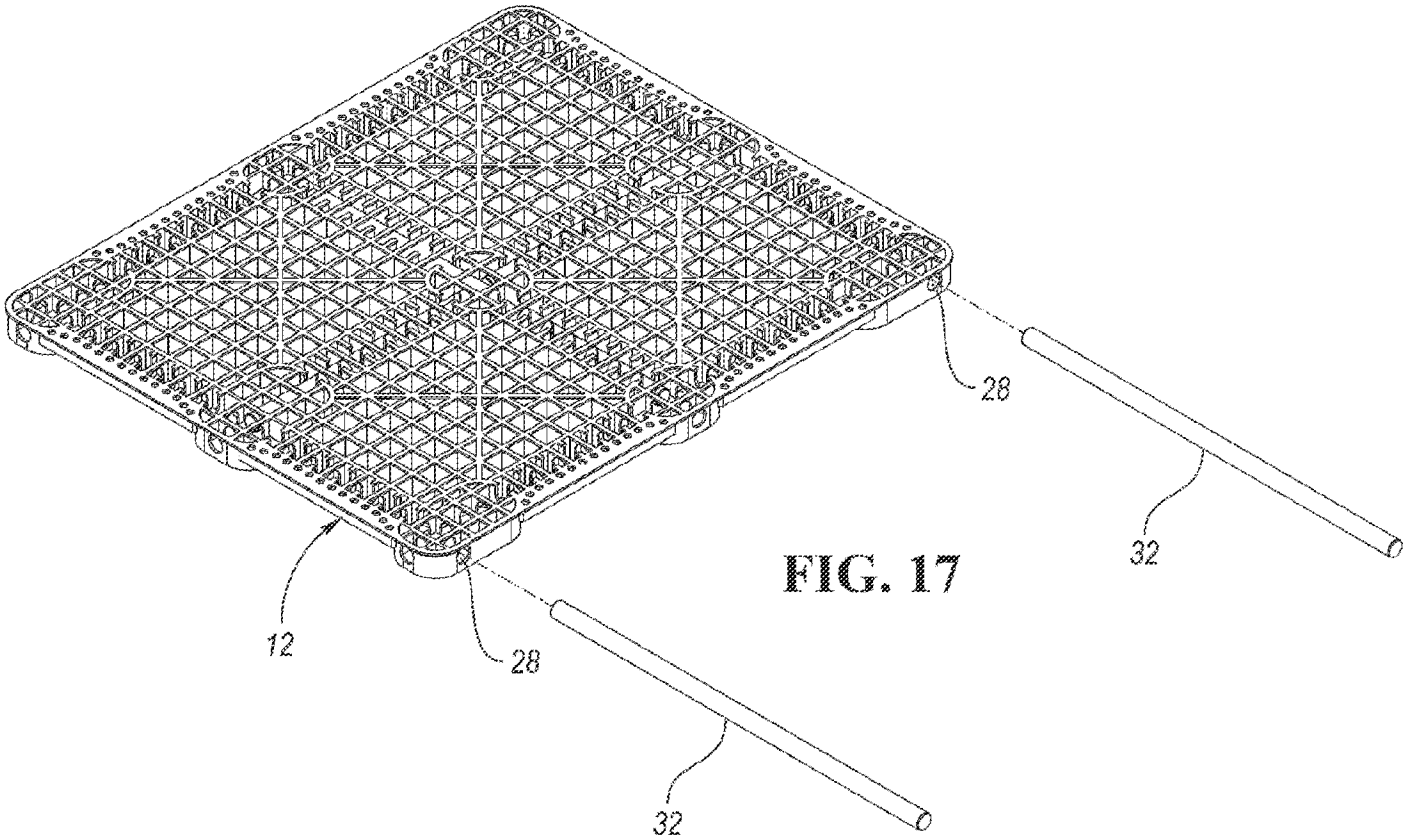
FIGS. 17 and 18 show a third step in assembling pallet assembly in the width-racking configuration.
Figure 18:
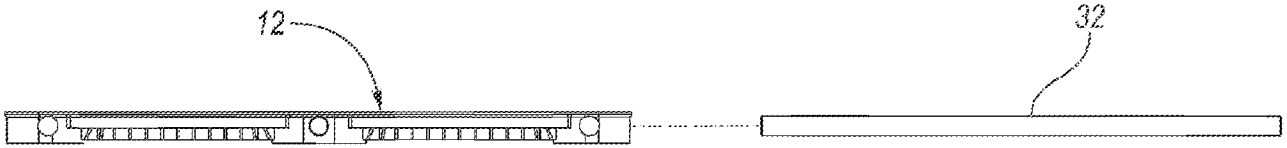

FIGS. 17 and 18 show a third step in assembling pallet assembly 10*a* in the width-racking configuration. In the third step, two exterior reinforcement members 32 are inserted into the channels 28 in the corner upper column portion 18 of the side edges of the upper portion 12 parallel to the first reinforcement member 32, outward of the two shorter, non-continuous interior reinforcement members 32 of the second step.

Figure 19:
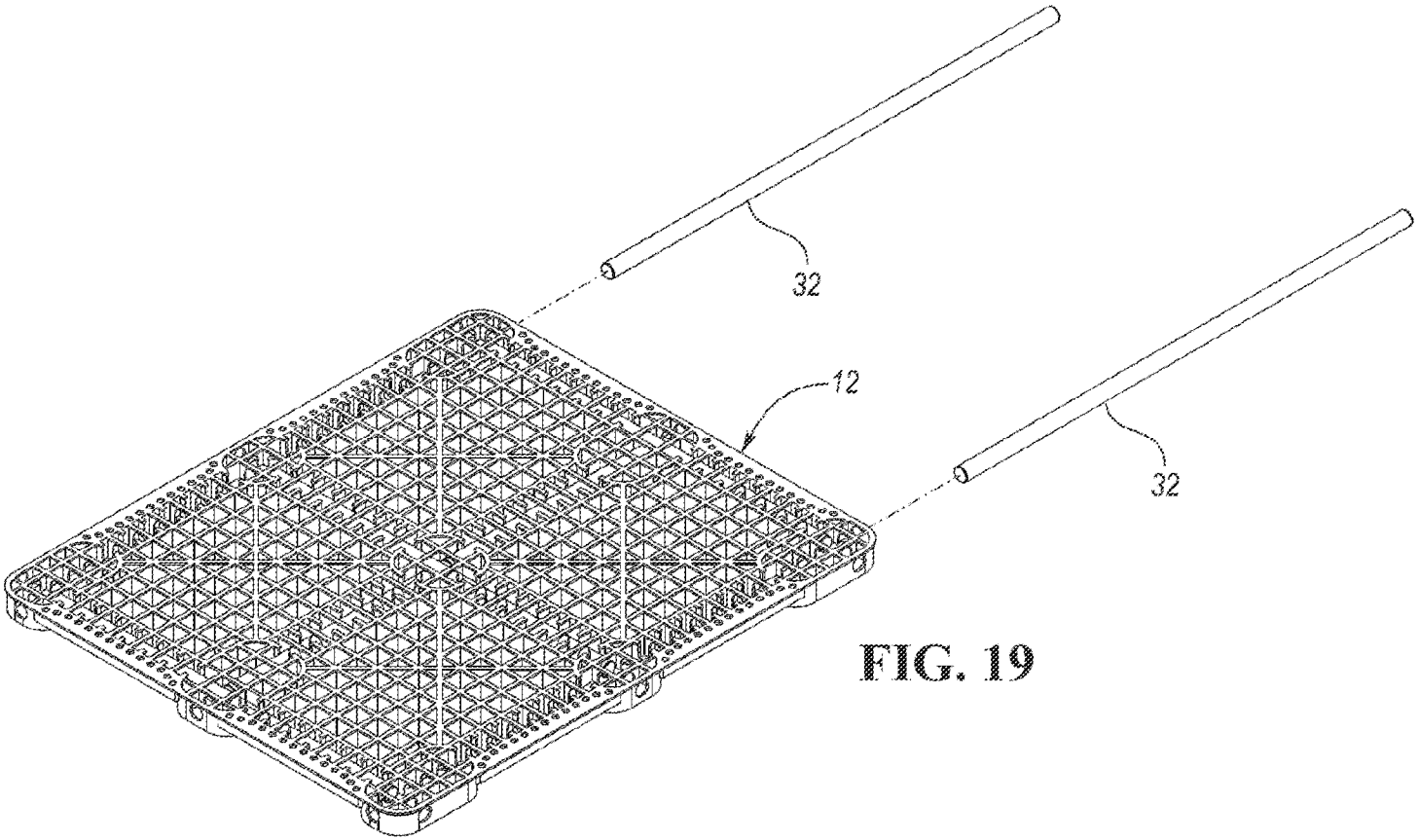
FIGS. 19 and 20 show a fourth step in assembling pallet assembly in the width-racking configuration.
Figure 20:
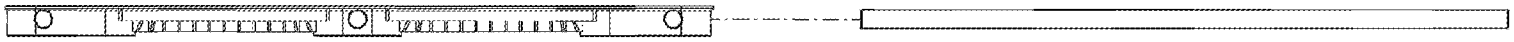

FIGS. 19 and 20 show a fourth step in assembling pallet assembly 10*a* in the width-racking configuration. In the fourth step, two exterior reinforcement members 32 are inserted into the channels 28 in the corner upper column portion 18 of the end edges of the upper portion 12 outward of the first reinforcement member 32, and outward of the two exterior reinforcement members 32 of the third step.

Figure 22:
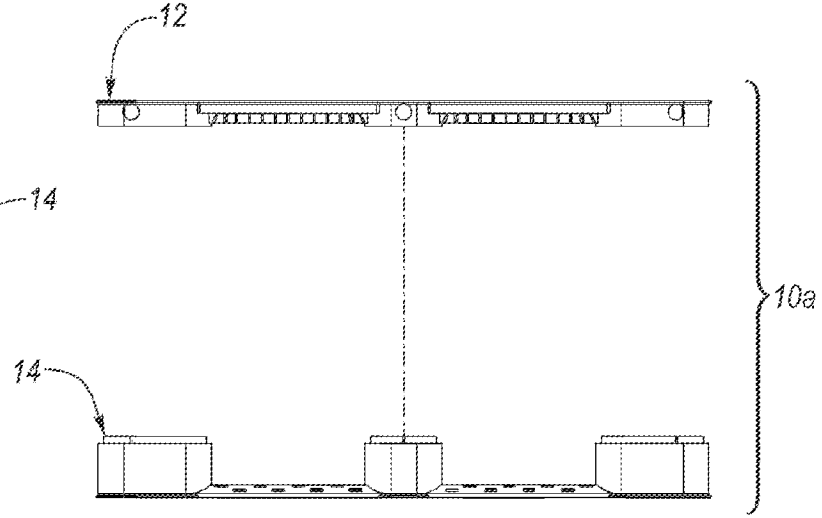
FIGS. 21 and 22 show the fifth step in assembling the pallet assembly in the width-racking configuration.
Figure 21:
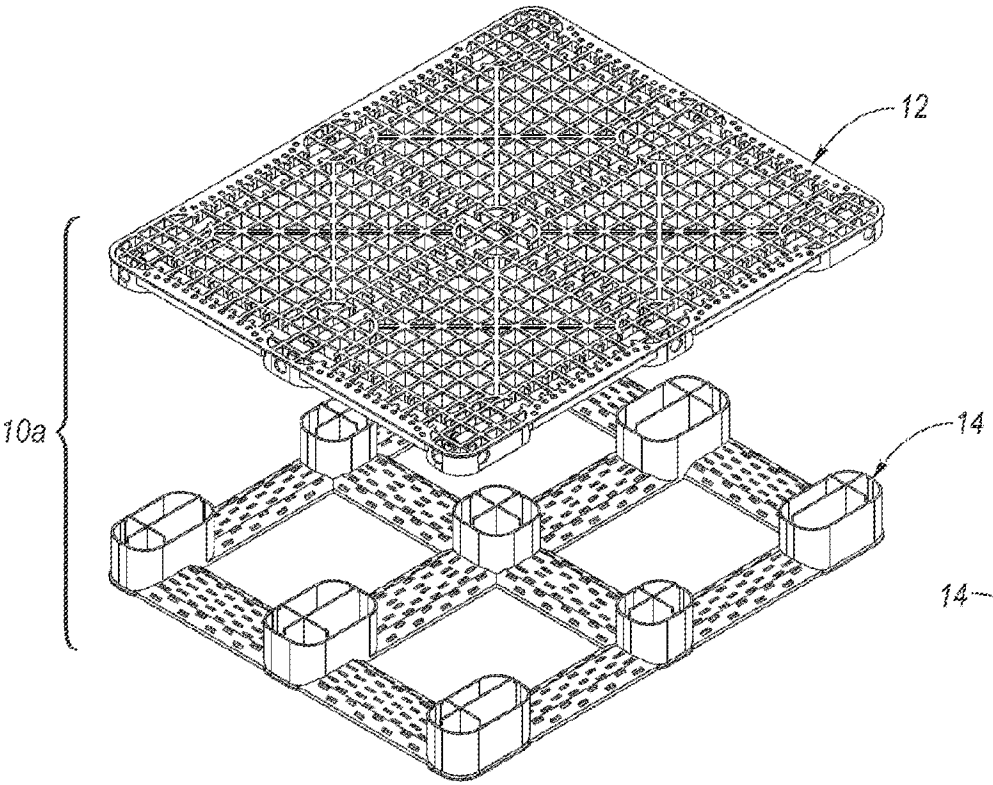

FIGS. 21 and 22 show the fifth step in assembling the pallet assembly 10*a* in the width-racking configuration. In the fifth step, the upper portion 12 (with the previously-inserted reinforcement members 32) is secured to the lower portion 14, such as by hot-plate welding (or snap-fit connection, etc, although hot-plate welding is preferred).

Figure 23:
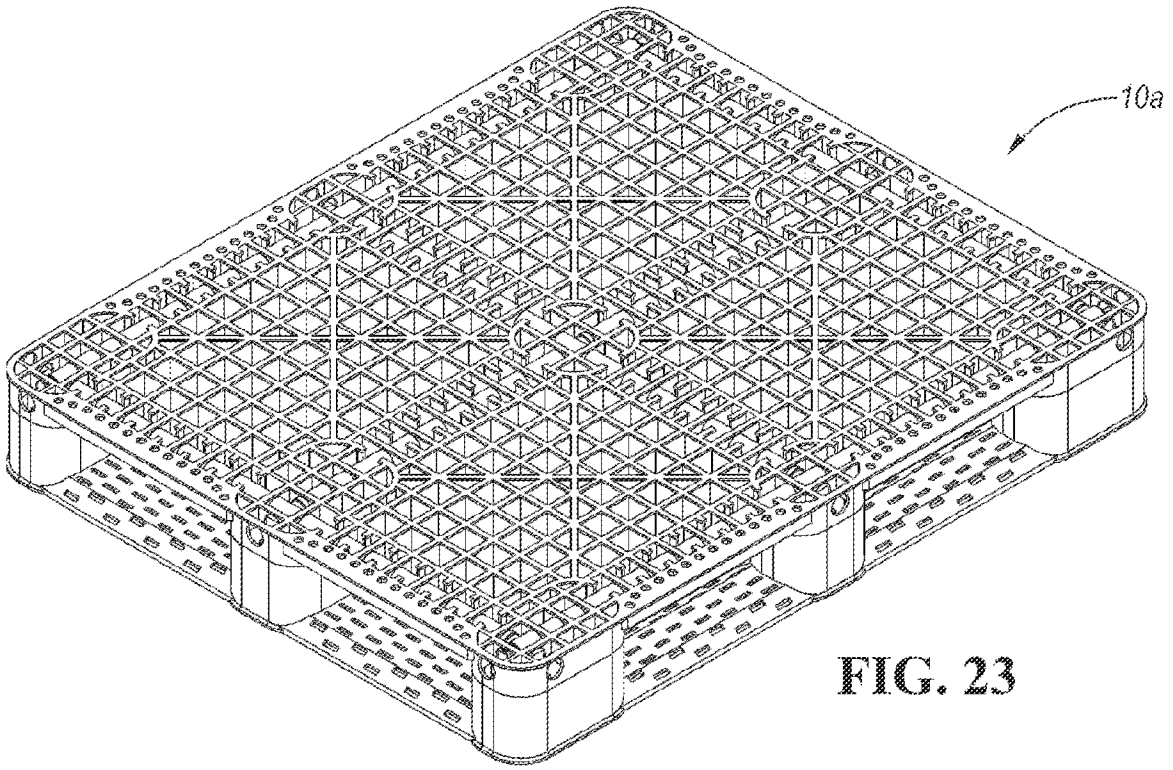
FIGS. 23 and 24 show the pallet assembly in the width-racking configuration.
Figure 24:
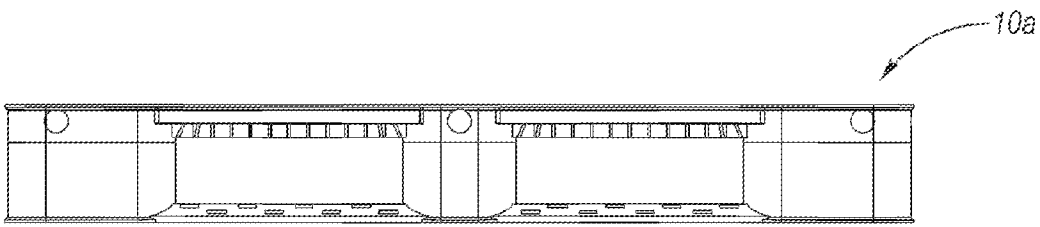

FIGS. 23 and 24 show the pallet assembly 10*a* in the width-racking configuration.

Figure 25:
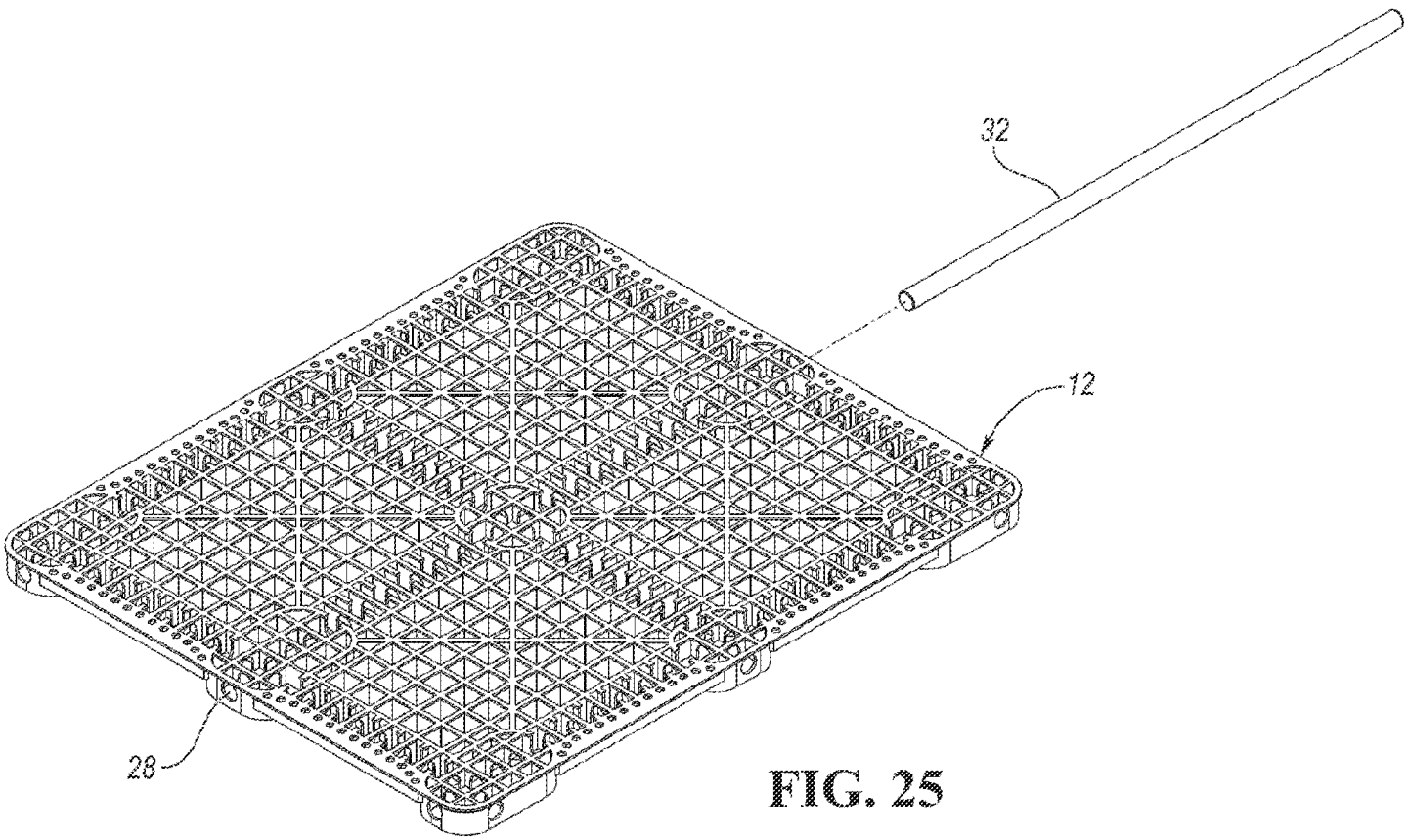
FIGS. 25 and 26 show a first step in assembling pallet assembly in the length-racking configuration.
Figure 26:
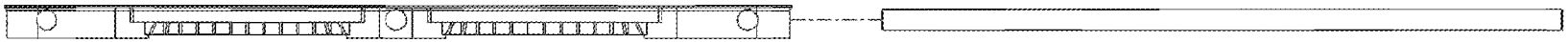

FIGS. 25 and 26 show a first step in assembling pallet assembly 10*b* in the length-racking configuration. In the first step, the single continuous interior reinforcement member 32 is inserted into the channel 28 in the middle upper column portion 18 of the end edge of the upper portion 12.

Figure 27:
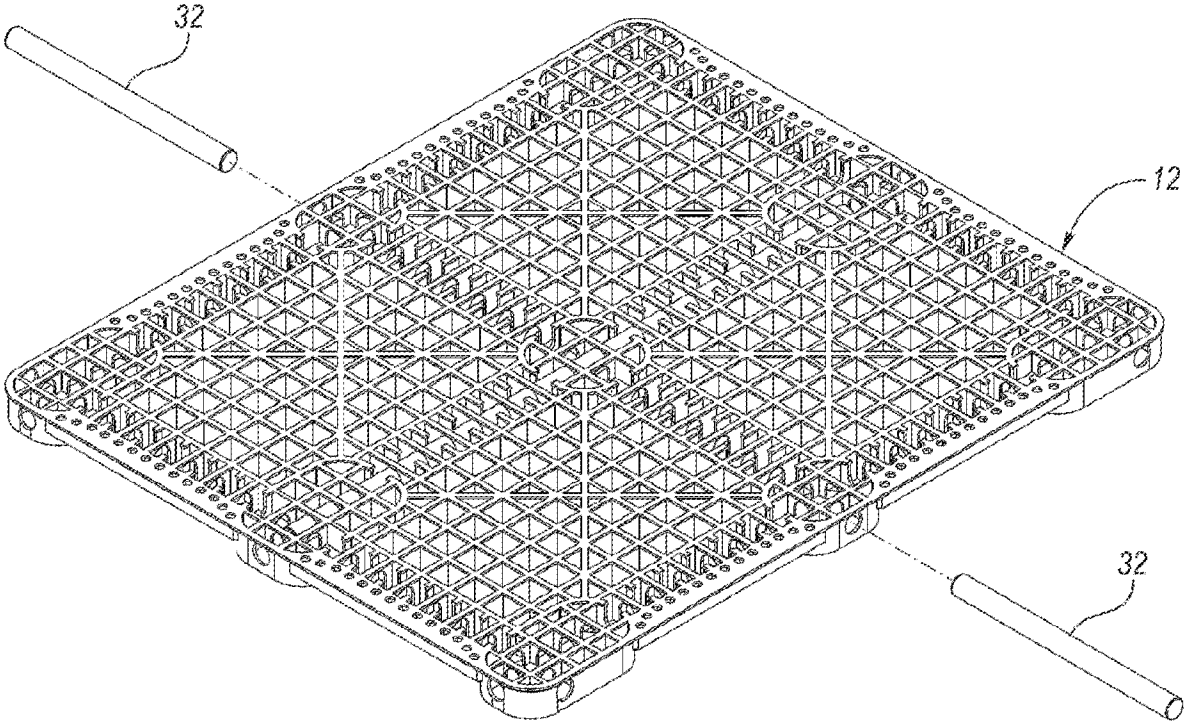
FIGS. 27 and 28 show a second step in assembling pallet assembly in the length-racking configuration.
Figure 28:
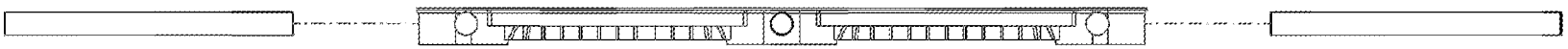

FIGS. 27 and 28 show a second step in assembling pallet assembly 10*b* in the length-racking configuration. In the second step, the two shorter, non-continuous interior reinforcement members 32 are inserted into the channels 28 in the middle upper column portion 18 of opposite side edges of the upper portion 12 toward the first reinforcement member 32.

Figure 29:
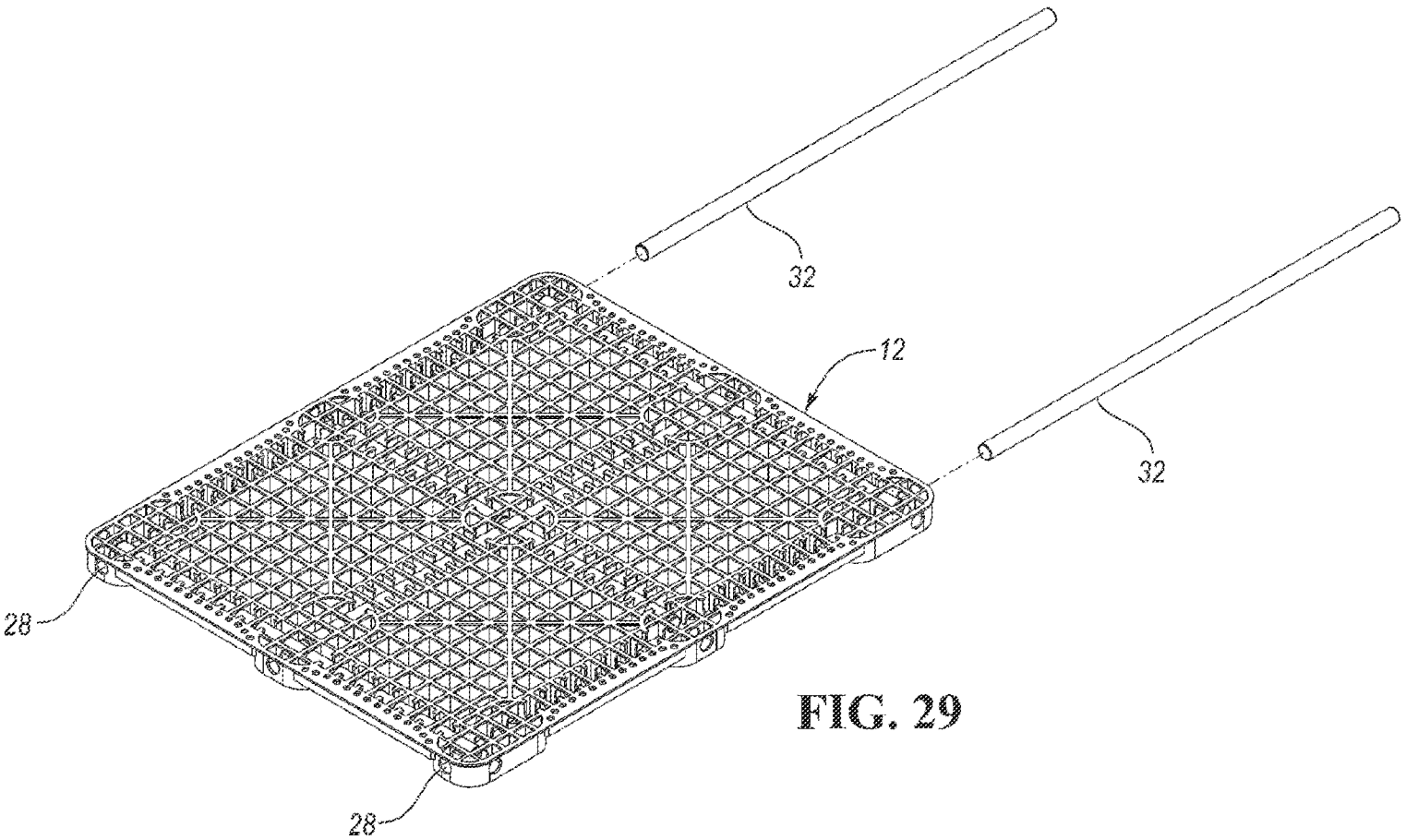
FIGS. 29 and 30 show a third step in assembling pallet assembly in the length-racking configuration.
Figure 30:
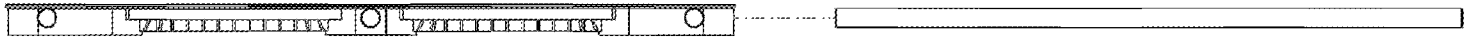

FIGS. 29 and 30 show a third step in assembling pallet assembly 10*b* in the length-racking configuration. In the third step, two exterior reinforcement members 32 are inserted into the channels 28 in the corner upper column portion 18 of the end edges of the upper portion 12 parallel to the first reinforcement member 32, outward of the two shorter, non-continuous interior reinforcement members 32 of the second step.

Figure 31:
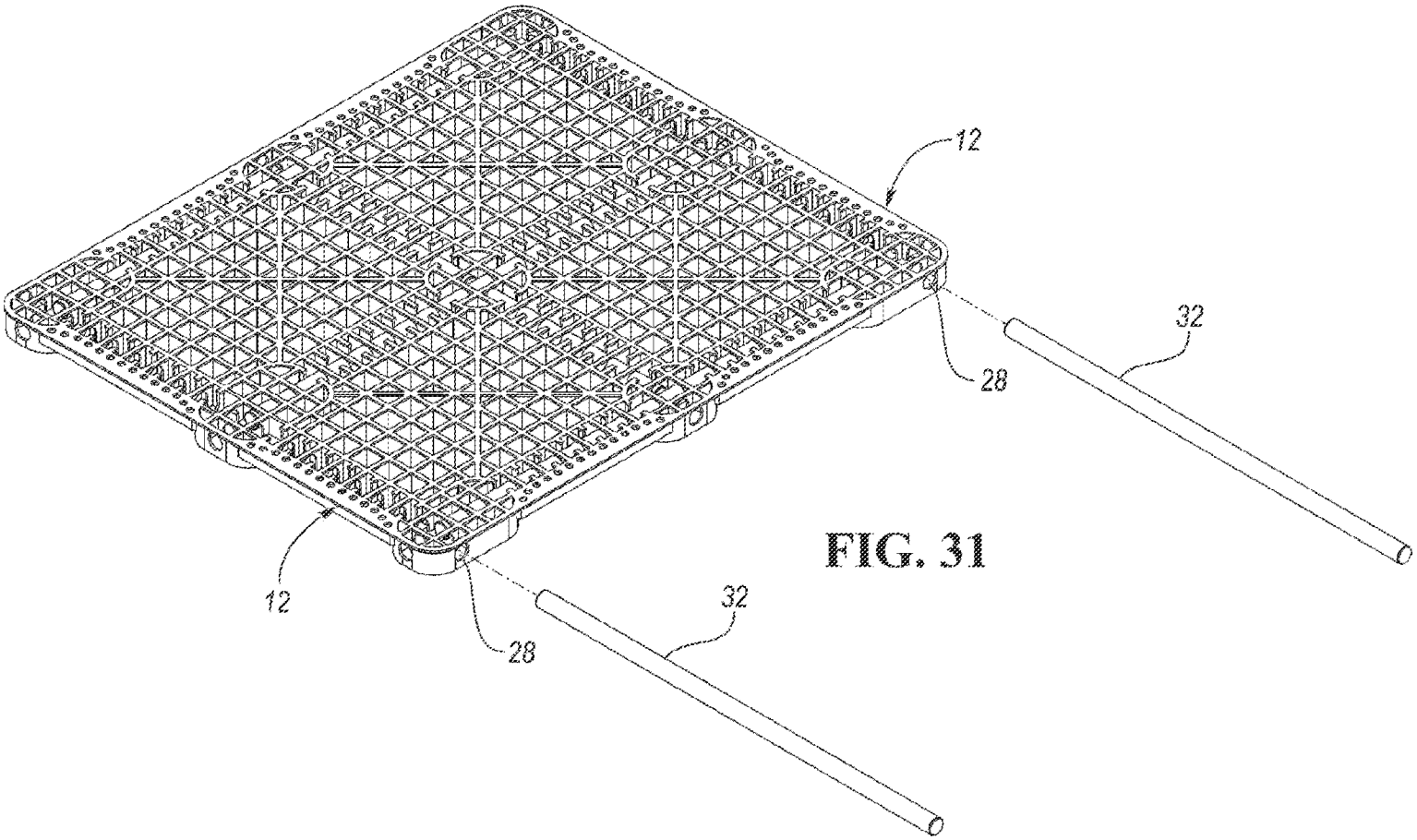
FIGS. 31 and 32 show a fourth step in assembling pallet assembly in the length-racking configuration.
Figure 32:
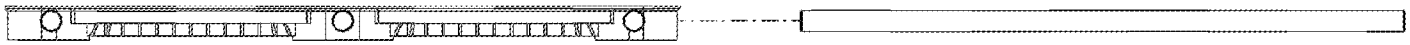

FIGS. 31 and 32 show a fourth step in assembling pallet assembly 10*b* in the length-racking configuration. In the fourth step, two exterior reinforcement members 32 are inserted into the channels 28 in the corner upper column portion 18 of the side edges of the upper portion 12 outward of the first reinforcement member 32, and outward of the two exterior reinforcement members 32 of the third step.

Figure 34:
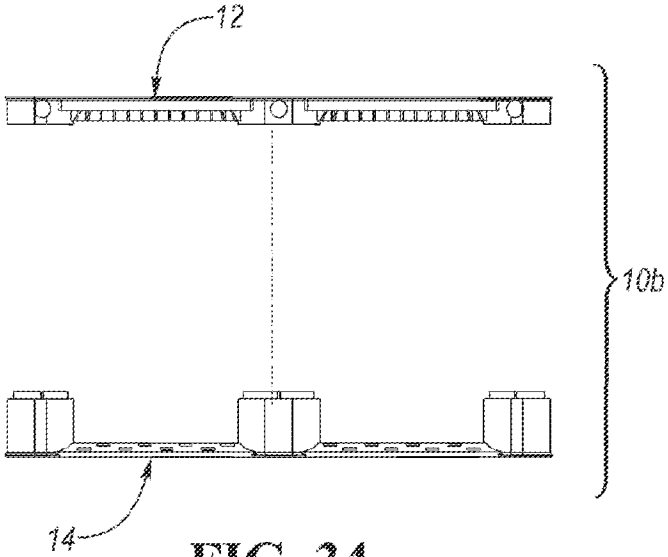
FIGS. 33 and 34 show the fifth step in assembling the pallet assembly in the length-racking configuration.
Figure 33:
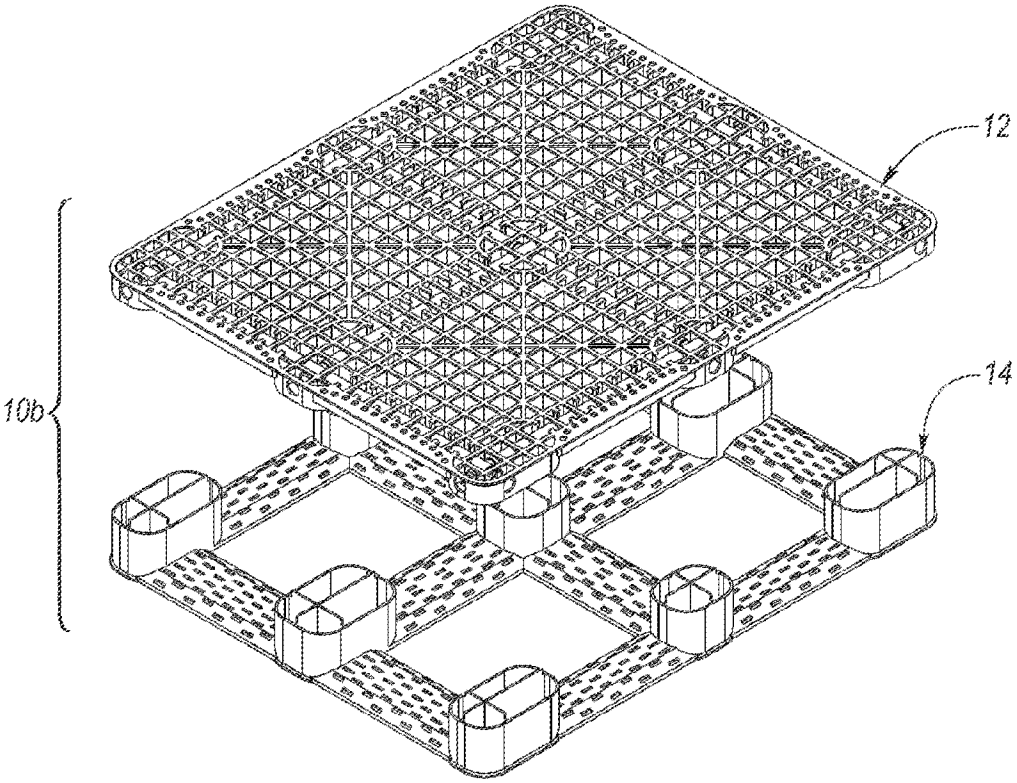

FIGS. 33 and 34 show the fifth step in assembling the pallet assembly 10*b* in the length-racking configuration. In the fifth step, the upper portion 12 (with the previously-inserted reinforcement members 32) is secured to the lower portion 14, such as by hot-plate welding (or snap-fit connection, etc, although hot-plate welding is preferred).

Figure 35:
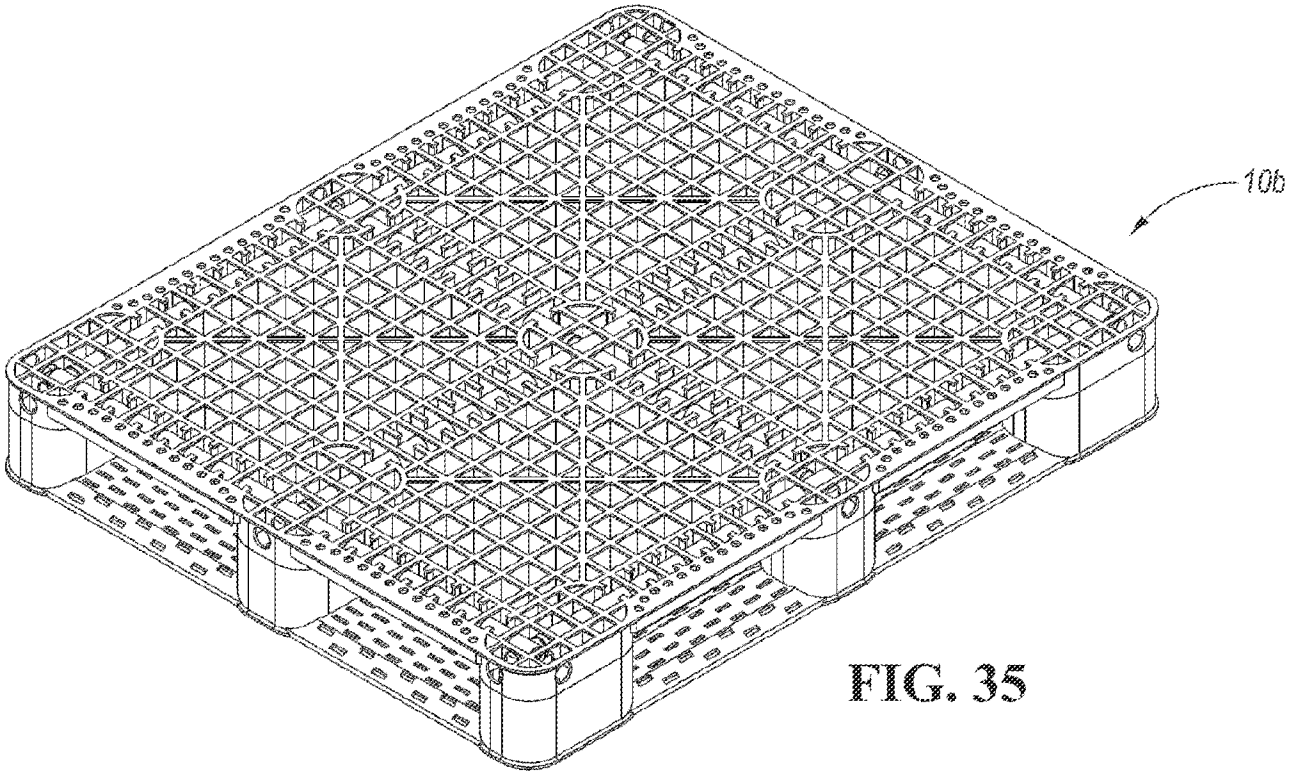
FIGS. 35 and 36 show the pallet assembly in the length-racking configuration.
Figure 36:
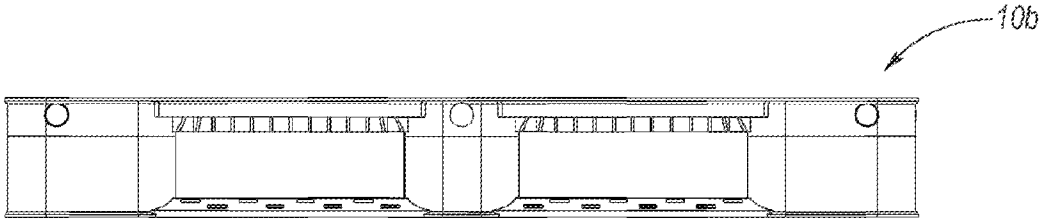

FIGS. 35 and 36 show the pallet assembly 10*b* in the length-racking configuration.

Figure 37:
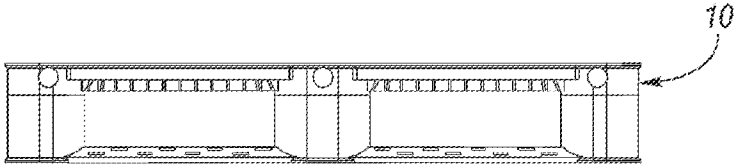
FIG. 37 is a side view of the pallet assembly assembled without reinforcement members.
Figure 39:
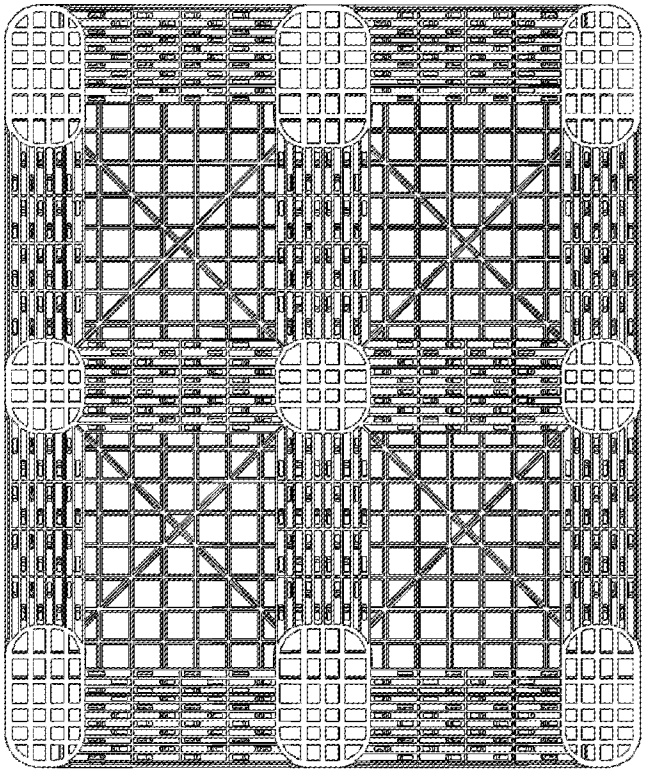
FIG. 39 is a bottom view of the pallet assembly of FIG. 37.
Figure 38:
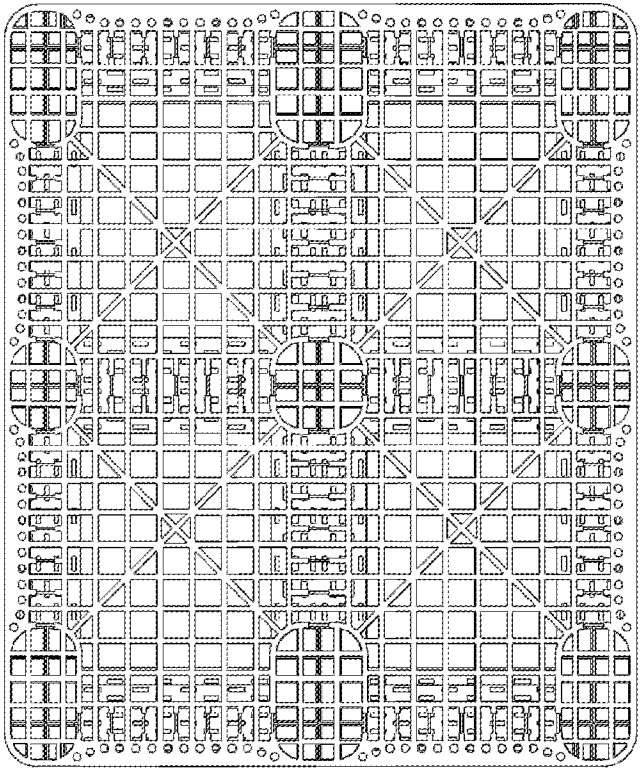
FIG. 38 is a top view of the pallet assembly of FIG. 37.

Alternatively, the pallet assembly 10 could be assembled and used without reinforcement members 32, as shown in FIGS. 37-39.

In this manner, the same pallet assembly 10 could be assembled and used in any one of the three configurations.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A pallet assembly comprising:

a deck including a first plurality of ribs and a second plurality of ribs, the first plurality of ribs each including a first opening therethrough that opens downward, the second plurality of ribs each including a second opening therethrough that opens upward to an upper support surface of the deck, the first openings and the second openings aligned to define a channel;

a reinforcement member disposed in the channel, wherein the reinforcement member is exposed through the second openings through the upper support surface of the deck; and a plurality of columns extending downward from the deck.

2. The pallet assembly of claim 1 wherein the deck is an upper deck and the plurality of columns extend downward from the deck.

3. The pallet assembly of claim 2 wherein the upper deck includes a plurality of upper column portions integrally molded with the deck, wherein the plurality of upper column portions include a first upper column portion, the channel extending into the first upper column portion, the reinforcement member disposed in the channel within the first upper column portion.

4. The pallet assembly of claim 3 wherein the plurality of columns each include a lower column portion having at least one column rib within the lower column portion, wherein the lower column portions are joined to the upper column portions, wherein the plurality of lower column portions includes a first lower column portion joined to the first upper column portion.

5. The pallet assembly of claim 4 wherein the reinforcement member abuts the column rib in the first lower column portion.

6. The pallet assembly of claim 5 wherein the first upper column portion has an outer wall with an opening therethrough further defining the channel, wherein the reinforcement member can be inserted through the opening through the outer wall of the first upper column portion.

7. The pallet assembly of claim 1 wherein the reinforcement member has a round cross section.

8. The pallet assembly of claim 7 wherein the reinforcement member is generally cylindrical.

9. The pallet assembly of claim 7 further including caps enclosing ends of the reinforcement member.

10. The pallet assembly of claim 1 wherein the reinforcement member is a first reinforcement member and the channel is a first channel, the deck further including a second channel transverse to the first channel such that a second reinforcement member in the second channel blocks the first reinforcement member from being removed from the first channel.

11. The pallet assembly of claim 1 wherein the reinforcement member is a first reinforcement member and the channel is a first channel, the deck further including a second channel transverse to the first channel such the first reinforcement member is between a second reinforcement member in the second channel and a third reinforcement member in the second channel.

12. The pallet assembly of claim 11 wherein the first channel is parallel to a long side of the deck.

13. The pallet assembly of claim 11 wherein the first channel is parallel to a short side of the deck.

14. The pallet assembly of claim 1 wherein the first plurality of ribs are integrally molded with the second plurality of ribs.

15. The pallet assembly of claim 1 wherein the first plurality of ribs and the second plurality of ribs extend to the upper support surface of the deck.

16. The pallet assembly of claim 1 wherein the first plurality of ribs and the second plurality of ribs are coplanar in a plane parallel to the upper support surface of the deck.

17. The pallet assembly of claim 1 wherein the first plurality of ribs and the second plurality of ribs each have horizontal flanges at upper edges thereof, defining the upper support surface of the deck.

18. The pallet assembly of claim 1 wherein the channel extends in a first direction parallel to the upper support surface of the deck and wherein the first plurality of ribs alternate with the second plurality of ribs along the first direction, and wherein each of the first plurality of ribs is spaced from all of the second plurality of ribs in the first direction or in a direction opposite the first direction.

19. A pallet assembly comprising:

an upper deck including a plurality of ribs, the plurality of ribs including a plurality of openings therethrough, the plurality of openings aligned to define a plurality of channels, the upper deck including a plurality of integral upper column portions, the plurality of channels extending through the upper column portions, wherein the plurality of ribs include a plurality of first ribs and wherein the openings through the plurality of first ribs are open downwardly of the upper deck and wherein the openings through the plurality of first ribs extend through a lowermost surface of the upper deck;

a plurality of reinforcement members disposed in the plurality of channels, wherein the reinforcement members are retained in the channels by the plurality of ribs; and a plurality of lower column portions secured to the upper column portions to form columns for supporting the upper deck above a floor.

20. The pallet assembly of claim 19 wherein the reinforcement member has a round cross section.

21. The pallet assembly of claim 19 wherein the plurality of channels includes three first channels extending in a direction parallel to side edges of the upper deck and three second channels extending in a direction parallel to end edges of the upper deck.

22. The pallet assembly of claim 21 wherein the plurality of reinforcement members includes a first reinforcement member in one of the first channels, and second and third reinforcement members in two of the second channels, wherein the first reinforcement member is between the second and third reinforcement members.

23. A pallet assembly comprising:

a deck including a first plurality of ribs and a second plurality of ribs, wherein the first plurality of ribs and the second plurality of ribs are coplanar in a plane parallel to an upper support surface of the deck, the first plurality of ribs each including a first opening therethrough that opens downward through a lowermost surface of the deck, the second plurality of ribs each including a second opening therethrough that opens upward through the upper support surface of the deck, the first openings and the second openings aligned to define a channel;

a reinforcement member disposed in the channel; and a plurality of columns extending downward from the deck.

24. The pallet assembly of claim 23 wherein the first plurality of ribs are integrally molded with the second plurality of ribs.

25. The pallet assembly of claim 23 wherein the first plurality of ribs and the second plurality of ribs extend to the upper support surface of the deck.

26. The pallet assembly of claim 25 wherein the first plurality of ribs and the second plurality of ribs each have horizontal flanges at upper edges thereof, the horizontal flanges defining the upper support surface of the deck.

27. The pallet assembly of claim 23 wherein the first plurality of ribs and the second plurality of ribs extend to the upper support surface of the deck.

28. A pallet assembly comprising:

a deck including a first plurality of ribs integrally molded with a second plurality of ribs, the first plurality of ribs each including a first opening therethrough that opens downward through the deck, the second plurality of ribs each including a second opening therethrough that opens upward through the deck, the first openings and the second openings aligned to define a channel;

a reinforcement member disposed in the channel; and a plurality of columns extending downward from the deck.

* * * * *